US005689786A

United States Patent [19]

Tokunaga et al.

[11] Patent Number: 5,689,786

[45] Date of Patent: Nov. 18, 1997

[54] IMAGE FORMING APPARATUS HAVING ENDLESS BELT PHOTOSENSITIVE MEMBER IN WHICH THE SOLIDIFIED DEVELOPER BECOMES MOLTEN

[75] Inventors: Hiroshi Tokunaga, Tokyo; Hideki Matsuzaka; Akira Shirakura, both of Kanagawa, all of Japan

[73] Assignee: Sony Corporation, Tokyo, Japan

[21] Appl. No.: 507,235

[22] PCT Filed: Dec. 27, 1994

[86] PCT No.: PCT/JP94/02271

§ 371 Date: Sep. 27, 1995

§ 102(e) Date: Sep. 27, 1995

[87] PCT Pub. No.: WO95/18402

PCT Pub. Date: Jul. 6, 1995

[30] Foreign Application Priority Data

Dec. 28, 1993 [JP] Japan ..... 5-338624

[51] Int. Cl.[6] ..... G03G 15/16

[52] U.S. Cl. ..... 399/307

[58] Field of Search ..... 355/212, 282, 355/285, 289; 430/124, 99; 219/216; 399/307

[56] References Cited

U.S. PATENT DOCUMENTS 4,708,460 11/1987 Langdon ..... 355/256
5,424,163 6/1995 Tokunaga et al. ..... 430/124

FOREIGN PATENT DOCUMENTS 453219 10/1991 European Pat. Off. .

*Primary Examiner*—William J. Royer
*Attorney, Agent, or Firm*—Jay H. Maioli

[57] ABSTRACT

An image forming apparatus includes an endless belt-shaped photosensitive member laid across a drive roller and a plurality of guide rollers and caused to undergo endless traveling, wherein there is used a solidified developer which is solid at an ordinary temperature but is brought into a molten state by implementing a heating processing thereto, and is re-solidified by implementing a cooling treatment thereto. An image preparation process section is disposed at the outer circumferential portion of the drive roller of large diameter, and a recording sheet contact roller and a recording sheet peeling roller which constitute guide rollers are disposed at an upper part of the drive roller so as to mutually constitute the same plane to travel the endless belt-shaped photosensitive member in a horizontal direction. A recording sheet is delivered from a recording sheet supply section and is caused to come into pressure contact with the surface of the endless belt-shaped photosensitive member traveling in the horizontal direction by the recording sheet's own rigidity. When the recording sheet is caused to undergo transfer of a developer image formed on the surface of the endless belt-shaped photosensitive member and is cooled by suitable element means, it is naturally peeled from the endless belt-shaped photosensitive member at a recording sheet peeling roller portion. Thus, a high accuracy transfer image free from image collapse or image flow, etc. can be obtained, and a compact structure and improvement in workability of maintenance, etc. can be realized.

19 Claims, 16 Drawing Sheets

IMAGE FORMING APPARATUS HAVING ENDLESS BELT PHOTOSENSITIVE MEMBER IN WHICH THE SOLIDIFIED DEVELOPER BECOMES MOLTEN

TECHNICAL FIELD

This invention relates to an image forming apparatus for carrying out printing or print of image (pictorial image) on the basis of a picture signal delivered from a scanner for reading a manuscript to be printed, or the like.

BACKGROUND

Hitherto, in various printers or copy machines, etc., as a system for forming an image (pictorial image) on the basis of a picture signal delivered from a scanner which has read a print manuscript, etc., an electrophotographic process system (so called Carlson process system) is widely adopted. This electrophotographic process system forms a pictorial image on a recording sheet through an image preparation process including electrification, exposure, development, transfer and/or fixing, etc. The system of development is classified into the wet development method and the dry development method dependant upon the state of the developer (developing agent). For example, in accordance with the wet development method, it is possible to obtain an image (pictorial image) of resolution and gradation comparable to that of a silver salt photograph.

As an example of the wet development method, there has been proposed an image forming apparatus using a solidified developer which is solid at an ordinary temperature, and is molten (fused) by implementing a heating processing (heat treatment) thereto and is re-solidified by implementing a cooling processing thereto. The solidified developer is an agent having the above-described property in which development particles are dispersed within a dispersion medium of a relatively low melting point. Handling of the developer is easy, and the conservative property and/or stability of characteristic, etc. at an ordinary temperature is excellent.

The applicant has already proposed an image (pictorial image) recording method using a solidified developer by "Image Recording Method" of the Japanese Patent Application Laid Open No. 197297/1993. This image recording method consists of an electrification process, exposure process, development process, transfer process, peeling (separation) process and cleaning process. The electrification process and the exposure process are similar to the electrophotographic process, wherein the surface of a photosensitive member on which a photosensitive layer is formed is uniformly electrified in the electrification process so that, e.g., minus charges result. In the next exposure process, laser beams based on a picture signal are irradiated onto the photosensitive member by means of a semiconductor laser, etc. so that minus charges of the exposed portion are caused to disappear, whereby an electrostatic latent image is formed on the surface of the photosensitive member.

The development process is a process for delivering a developer in which development particles of plus charges are dispersed in a dispersion medium to the surface of the photosensitive member on which an electrostatic latent image is formed to form a developer a image. As the developer, solidified developer molten (fused) by heating means is used. The transfer process is a process for allowing a recording sheet to be closely in contact with the surface of the photosensitive member on which the developer image is formed to transfer the developer image in a molten state onto the recording sheet. The recording sheet onto which the developer image has been transferred is peeled out from the photosensitive member in the next peeling process. The photosensitive member is caused to undergo a processing in which the solidified developer remaining on the surface is eliminated, and is forwarded to a series of process steps starting from the electrification process for a second time.

In the above-described earlier application image forming apparatus, as a photosensitive member, an endless belt-shaped photosensitive member laid across a drive roller and a plurality of guide rollers and caused to undergo endless traveling is used. Such an endless belt-shaped photosensitive member has the feature that, as compared to an image forming apparatus using a photosensitive drum, the close contact traveling path between, e.g., the photosensitive member and the recording sheet is sufficiently ensured so that a reliable transfer can be carried out, and the compact structure of the apparatus can be attained.

In the earlier application image recording method featured as described above, a recording sheet delivered from the recording sheet supply section after having undergone the development process travels in close contact with the surface of the endless belt-shaped photosensitive member, whereby the developer image in the molten state is transferred onto the surface of the recording sheet. However, with respect to the developer image at this time, in the case where, e.g., the solidified developer has been already solidified at the close; contact portion of the recording sheet, a problem such that a transfer onto the recording sheet side cannot be reliably carried out would arise.

Moreover, with respect to the developer image, in the state where the solidified developer has high fluidity, before the recording sheet comes closely into contact with the surface of the endless belt-shaped photosensitive member and is transferred thereto, image flow phenomenon would take place or image collapse resulting from the fact that an image is expanded to the surface of the closely contact recording sheet would take place. Accordingly, the molten state of the developer image for a time period from the development process up to the supply section of the recording sheet must be caused to undergo management with high accuracy.

Meanwhile, in copy machines, etc., there are instances where a recording sheet delivered from the recording sheet supply section may be clogged on the way, so that a jam phenomenon might take place. For this reason, in copy machines, etc., it is necessary to adopt a structure to immediately cope with such jam phenomenon, etc. In the earlier application image recording method, there is the problem that because there is employed a configuration in which a recording sheet is traveled in the state where it is closely in contact with the endless belt-shaped photosensitive member within the oblique traveling path, the structure for coping with jam phenomenon, etc. becomes complicated, and workability (working efficiency) is also poor.

Moreover, in the image recording apparatus, since the developer image is transferred with high accuracy, it is preferable that the endless belt-shaped photosensitive member and the recording sheet be closely in contact with each other at the position where they are traveled in a stable state. The earlier application image recording method had the problem that since there is employed a configuration in which the recording sheet is caused to be closely in contact with the endless belt-shaped photosensitive member within the oblique traveling path as described above, such endless belt-shaped photosensitive member and/or recording sheet are apt to undergo influence of gravity or vibration, etc., so that a special structure for stable traveling is required.

Accordingly, this invention has been proposed with a view to providing an image (or pictorial image) forming apparatus adapted to allow solidified developer for forming a developer image on the surface of an endless belt-shaped photosensitive member to undergo management at the supply section for the recording sheet so that it is in a reasonable molten state, and to allow transfer operation of the developer image onto the recording sheet to be carried out at a horizontal traveling section where the endless belt-shaped photosensitive member is traveled in a stable state, thereby realizing improvement in transfer accuracy and working efficiency of maintenance.

DISCLOSURE OF THE INVENTION

In the image forming apparatus according to this invention, there is used a solidified developer where development particles are dispersed within a dispersion medium, which is solid at an ordinary temperature, and is molten by implementing heating processing thereto and is re-solidified by implementing cooling processing thereto. The image forming apparatus includes an endless belt-shaped photosensitive member which is laid across a traveling guide portion composed of a drive roller of larger diameter and a pair of guide rollers disposed so that respective outer circumferential portions mutually constitute the same plane with respect to horizontal direction, and is caused to undergo endless traveling. The image forming apparatus includes an image preparation process section disposed at the outer circumferential portion of the drive roller along the traveling direction of the endless belt-shaped photosensitive member. The image preparation process section is composed of electrification means for carrying out electrification over the entire surface of the endless belt-shaped photosensitive member, exposure means for allowing the surface of the photosensitive member electrified on the basis of a picture signal sent out from a control unit to be exposed to light to form an electrostatic latent image, and developing means for delivering a solidified developer in molten state to the surface of the photosensitive member to form a developer image corresponding to the electrostatic latent image. The image forming apparatus includes heating the means for heating endless belt-shaped photosensitive member on which a developer image is formed and/or a recording sheet delivered from a recording sheet supply section and caused to be closely in contact with the endless belt-shaped photosensitive member so that each temperature is more than the melting point of the dispersion medium of the solidified developer to allow the developer image to be placed in a molten state. The image forming apparatus includes, at the front end portion of horizontal traveling path of the endless belt-shaped photosensitive member, cooling means for cooling the endless belt-shaped photosensitive member with which recording sheet is closely in contact and the recording sheet to thereby allow solidified developer in the molten state for forming the developer image to be re-solidified on the surface of the recording sheet so that the developer image is transferred thereto.

Moreover, in the image forming apparatus according to this invention, there is used a recording sheet on which a resin layer compatible with that of the dispersion medium of the solidified developer is formed at the surface of the side closely in contact with the surface of at least the endless belt-shaped photosensitive member of base.

Further, the image forming apparatus according to this invention is of a structure in which the drive roller is formed by metal material of relatively light weight having high thermal conductivity, and heating means for heating the endless belt-shaped photosensitive member so that its temperature is more than the melting point of the dispersion medium of the solidified developer is disposed within the drive roller.

Furthermore, in the image forming apparatus according to this invention, a pair of guide rollers constituting the traveling guide section of the endless belt-shaped photosensitive member are composed of a recording sheet contact roller for allowing the endless belt-shaped photosensitive member traveled from the drive roller side to undergo turn-back traveling, and for allowing the recording sheet delivered from the recording sheet supply section disposed at the side section to be traveled in the state where the recording sheet is laid upon the surface of the endless belt-shaped photosensitive member; and a recording sheet peeling roller for allowing the endless belt-shaped photosensitive member caused to be turned back and traveled by the recording sheet contact roller to undergo turn-back traveling to the drive roller side, and for allowing the recording sheet to which the developer image has been transferred to be peeled from the endless belt-shaped photosensitive member.

Furthermore, the image forming apparatus according to this invention is of a structure in which the recording sheet contact roller and the recording sheet peeling roller are disposed in a manner located at an upper portion with respect to the drive roller to thereby allow the horizontal traveling section of the endless belt-shaped photosensitive member where the recording sheet is traveled in the state laid thereupon to be located at an upper portion of the image preparation process section.

Further, the image forming apparatus according to this invention is of a structure in which the drive roller constituting the traveling guide section of the endless belt-shaped photosensitive member, the recording sheet contact roller and the recording sheet peeling roller are assembled into a chassis which can be drawn toward an upper portion with respect to an apparatus casing.

Further, the image forming apparatus according to this invention is of a structure in which at least any one of the recording sheet contact roller and the recording sheet peeling roller for carrying out traveling guidance of the endless belt-shaped photosensitive member is supported at a movable supporting portion in which the fixed position can be adjusted with respect to the chassis, and the movable supporting portion is fixed after undergoing adjustment movement to thereby carry out tension adjustment of the endless belt-shaped photosensitive member.

Further, the image forming apparatus according to this invention is of a structure in which there is disposed, between the recording sheet contact roller and the recording sheet supply section, recording sheet guide means adapted for traveling the recording sheet delivered from the recording sheet section so as to allow it to come into collision (contact) with the surface of the endless belt-shaped photosensitive member turned back by the recording sheet contact roller to thereby allow the recording sheet to be laid upon the surface of the endless belt-shaped photosensitive member in the state where a very small pressure is applied thereto.

Further, the image forming apparatus according to this invention is of a structure in which a recording sheet bending portion bends, with respect to the traveling direction, a portion of the recording sheet so that it comes into contact with the surface of the endless belt-shaped photosensitive member at the recording sheet guide means.

Further, in the image forming apparatus according to this invention, the recording sheet guide means is constituted by a guide member for supporting the recording sheet delivered from the recording sheet supply section, and a recording sheet supply roller in which the support shaft is disposed at an upper position slightly close to the recording sheet supply portion side with respect to the support shaft of the recording sheet contact roller, and the recording sheet contact roller in between the recording sheet supply roller and the guide member to conduct a control such that the recording sheet supply roller delivers, to the recording sheet contact roller, the recording sheet at a traveling speed different from a traveling speed of the endless belt-shaped photosensitive member.

Further, in the image forming apparatus according to this invention, the recording sheet guide means is constituted by a guide member for supporting the recording sheet delivered from the recording sheet supply section, and a recording sheet supply roller in which the support shaft is disposed at an upper position slightly close to the recording sheet supply section side with respect to the support shaft of the recording sheet contact roller, and the recording sheet contact roller in between the recording sheet supply roller and the guide roller, and the recording sheet supply roller upon which travels the recording sheet is caused to come into contact with the outer circumferential portion thereof toward the recording sheet contact roller side to allow the recording sheet to be laid upon the surface of the endless belt-shaped photosensitive member by pressure contact force based on the rigidity thereof.

Further, the image forming apparatus according to this invention is of a structure in which the recording sheet supply roller is supported so that it comes into contact with the guide member for supporting the recording sheet, or is away therefrom, thus making it possible to adjust the pressure contact force with respect to the endless belt-shaped photosensitive member of the recording sheet.

Further, the image forming apparatus according to this invention is such that the recording sheet guide means is constituted by a recording sheet supply roller in which the support shaft is disposed at a position of an upper portion slightly close to the recording sheet supply section side with respect to the support shaft of the recording sheet contact roller and adapted for supporting the recording sheet delivered from the recording sheet supply section, and a guide member disposed at an upper position in a manner opposite to the recording sheet supply roller and adapted to travel the recording sheet toward the recording sheet contact roller side in between the recording sheet supply roller and the guide member.

Further, the image forming apparatus according to this invention is of a structure in which the recording sheet heating means for traveling the recording sheet toward the recording sheet contact roller side in the heated state so that its temperature is more than the melting point of the dispersion medium of the solidified developer to allow the recording sheet to be closely in contact with the endless belt-shaped photosensitive member is disposed between the recording sheet supply section and the recording sheet contact roller.

Further, the image forming apparatus according to this invention is such that the recording sheet heating means is constituted by a recording sheet supply roller formed tubular, and heating means disposed within the recording sheet supply roller.

Further, the image forming apparatus according to this invention is of a structure in which the recording sheet preliminary heating means for heating the recording sheet so that its temperature is more than the melting point of the dispersion medium of the solidified developer is disposed between the recording sheet guide means and the recording sheet contact roller.

Further, the image forming apparatus according to this invention is of a structure in which the recording sheet preliminary heating means is constituted by a guide roller formed tubular, which is disposed on the recording sheet supply side with respect to the recording sheet supply roller and is adapted to support the recording sheet to travel it toward the recording sheet contact roller side, and heating means disposed within the guide roller.

Further, the image forming apparatus according to this invention is of a structure in which the recording sheet contact roller is caused to be formed tubular so that heating means is disposed therein.

Further, the image forming apparatus according to this invention is of a structure in which cooling means is disposed in correspondence with the endless belt-shaped photosensitive member traveled in a horizontal direction between the recording sheet contact roller and the recording sheet peeling roller to cool the endless belt-shaped photosensitive member and the recording sheet so that their temperatures are less than the melting point of the dispersion medium of the solidified developer by the time they reach the recording sheet peeling roller.

In accordance with the image forming apparatus according to this invention constituted in a manner as described above, in the process where the endless belt-shaped photosensitive member is caused to undergo endless traveling by the traveling guide portion composed of drive roller and guide roller, electrification of the surface and formation of an electrostatic latent image are carried out in the image preparation process section, and the solidified developer caused to be in a molten state is delivered thereto, at which point development of the electrostatic latent image is carried out. Thus, a developer image which is a solidified developer portion having no electrostatic coupling force is formed on the surface in correspondence with the electrostatic latent image. In the process where the endless belt-shaped photosensitive member is further traveled, a recording sheet delivered from the recording sheet supply section is caused to be closely in contact with the endless belt-shaped photosensitive member at the horizontal traveling section constituted between a pair of guide rollers and adapted so that the endless belt-shaped photosensitive member is traveled in a stable state, and both the endless belt-shaped photosensitive member and the recording sheet are traveled in a horizontal direction in the state in which they are closely in contact with each other.

With respect to the solidified developer in a molten state which has been attached on the surface of the endless belt-shaped photosensitive member, the endless belt-shaped photosensitive member and/or the recording sheet are heated by the heating means so that their temperatures are above the melting point of the dispersion medium of the solidified developer, whereby the molten state is held. Thus, a developer image portion having no electrostatic coupling force is transferred from the endless belt-shaped photosensitive side onto the recording sheet closely in contact therewith. Further, the recording sheet is cooled by cooling means. As a result, the solidified developer is re-solidified on the recording sheet. Thus, a transfer image is formed.

Since transfer operation of the developer image is carried out at the horizontal traveling path portion where the endless belt-shaped photosensitive member is traveled in a stable state, satisfactory transfer free from movement of image, etc. is carried out. The endless belt-shaped photosensitive member and the recording sheet are peeled off by peeling means disposed at the front end side of the horizontal traveling section. The endless belt-shaped photosensitive member is caused to undergo endless traveling for a second time, and is forwarded to a series of image formation operations. The recording sheet is sent to the ejecting section.

In the image forming apparatus, a recording sheet in which a resin layer compatible with the dispersion medium of the solidified developer is formed at the surface closely in contact with the endless belt-shaped photosensitive member is used, whereby the developer image formed on the surface of the endless belt-shaped photosensitive member is extremely satisfactorily transferred in the state where the recording sheet is closely in contact with the endless belt-shaped photosensitive member.

The image forming apparatus is adapted to travel the endless belt-shaped photosensitive member in a horizontal direction between the recording sheet contact roller and the recording sheet peeling roller so that the recording sheet is closely in contact at one end side of the horizontal traveling path, the recording sheet is peeled off at the other end side, the developer image is transferred to the recording sheet side within the horizontal traveling path and the recording sheet is cooled, whereby a series of operations from supply to peeling of the recording sheet with respect to the endless belt-shaped photosensitive member is carried out in a stable state. Thus, satisfactory transfer and peeling operations of the developer image are carried out.

Since the image forming apparatus is adapted so that the transfer section where the endless belt-shaped photosensitive member and the recording sheet are traveled in such a manner that they overlap with each other is located at an upper portion of the image preparation process portion, even in the event that the recording sheet is clogged, so jam phenomenon takes place, it becomes possible to easily remove the recording sheet.

Moreover, in the image forming apparatus, in the case where a clogging accident of the recording sheet takes place, since the chassis is drawn out from the apparatus casing toward the upper portion so that the recording sheet can be removed, maintenance is easily carried out.

In the image forming apparatus, since the recording sheet is traveled in a manner such that it is laid upon the surface of the endless belt-shaped photosensitive member in the state where a very small pressure is applied thereto by its own rigidity, a pressure contact mechanism for allowing the recording sheet to be forced on the surface of the endless belt-shaped photosensitive member, or the like becomes unnecessary. As a result, simplification of the apparatus is realized. In addition, occurrence of phenomenon of collapse, etc. of the transfer image by excessive pressure contact force at the time of adjustment of pressure contact force at the pressure contact mechanism is prevented.

Moreover, in the image forming apparatus, a portion of the recording sheet caused to be in collision with the endless belt-shaped photosensitive member is bent in a traveling direction at the recording sheet bending (flexible) portion, whereby difference of traveling speed between the endless belt-shaped photosensitive member and the recording sheet is adjusted.

The image forming apparatus is adapted to control, by the recording sheet supply roller, traveling speed of the recording sheet so that it is different from traveling speed of the endless belt-shaped photosensitive member to thereby allow the travel-driving force of the recording sheet to have no influence on the travel-driving force of the endless belt-shaped photosensitive member in the state where the recording sheet is traveled within the horizontal traveling path in such a manner laid upon the endless belt-shaped photosensitive member. Accordingly, in the image forming apparatus, occurrence of inconvenience such as rubbing (friction) phenomenon of transfer image or increase in load of the traveling guide portion produced by difference of traveling speed between the endless belt-shaped photosensitive member and the recording sheet can be prevented.

In the image forming apparatus, the recording sheet supply roller constituting the recording sheet guide means is adjustably moved with respect to the guide member, whereby the bending (curvature) quantity of the recording sheet is adjusted. Thus, pressure contact force due to rigidity is adjusted. Accordingly, the image forming apparatus is permitted to allow plural kinds of recording sheets having different thicknesses to be laid upon the endless belt-shaped photosensitive member by a fixed pressure contact force.

In the image forming apparatus, the recording sheet is laid upon the endless belt-shaped photosensitive member in the state where the recording sheet is heated by the recording sheet heating means so that its temperature is above melting point of the dispersion medium of the solidified developer, whereby the solidified developer of developer image formed on the surface of the endless belt-shaped photosensitive member is caused to be securely in a molten state. Accordingly, there is no possibility that an inconvenience such that a portion of transfer image is missing may take place, so the developer image is securely transferred from the endless belt-shaped photosensitive member side to the recording sheet. The recording sheet heating means is provided within the recording sheet supply roller constituting the recording sheet guide means. Thus, the structure is simplified and the apparatus is caused to be compact.

In the image forming apparatus, the recording sheet is laid upon the endless belt-shaped photosensitive member through the recording sheet guide means in the state heated so that its temperature is above the melting point of dispersion medium of the solidified developer by a recording sheet preliminary heating means, whereby the solidified developer of developer image formed on the surface of the endless belt-shaped photosensitive member is caused to be securely in molten state. Since the recording sheet preliminary heating means is independently disposed, temperature management of a high accuracy can be conducted. Accordingly, there is also no possibility that an inconvenience such that a portion of transfer image is missing may take place. Thus, the developer image is permitted to be securely transferred from the endless belt-shaped photosensitive member to the recording sheet.

In the image forming apparatus, the endless belt-shaped photosensitive member is turned back in a horizontal direction in the state heated so that its temperature is more than the melting point of the dispersion medium of the solidified developer by heating means disposed within the recording sheet contact roller, thus allowing the solidified developer of the developer image formed on the surface of the endless belt-shaped photosensitive member to be securely in a molten state. Accordingly, the developer image is securely transferred from the endless belt-shaped photosensitive member to the recording sheet without the possibility that an inconvenience such that a portion of transfer image is missing may take place.

In the image forming apparatus, for a time period during which the recording sheet is peeled from the endless belt-shaped photosensitive member by the recording sheet peeling roller, the endless belt-shaped photosensitive member and the recording sheet are cooled by cooling means so that the temperatures are less than the melting point of the dispersion medium of the solidified developer to securely re-solidify the developer image, whereby the peeling (separating) operation between the endless belt-shaped photosensitive member and the recording sheet is naturally carried out without use of special peeling means. Thus, smoothness of the surface of the transfer image is held. Accordingly, in the image forming apparatus, means for carrying out peeling between the endless belt-shaped photosensitive member and the recording sheet becomes unnecessary. Thus, simplification of the structure is realized, and a glossy satisfactory transfer image is obtained.

BEST MODE FOR CARRYING OUT THE INVENTION

Figure 1:
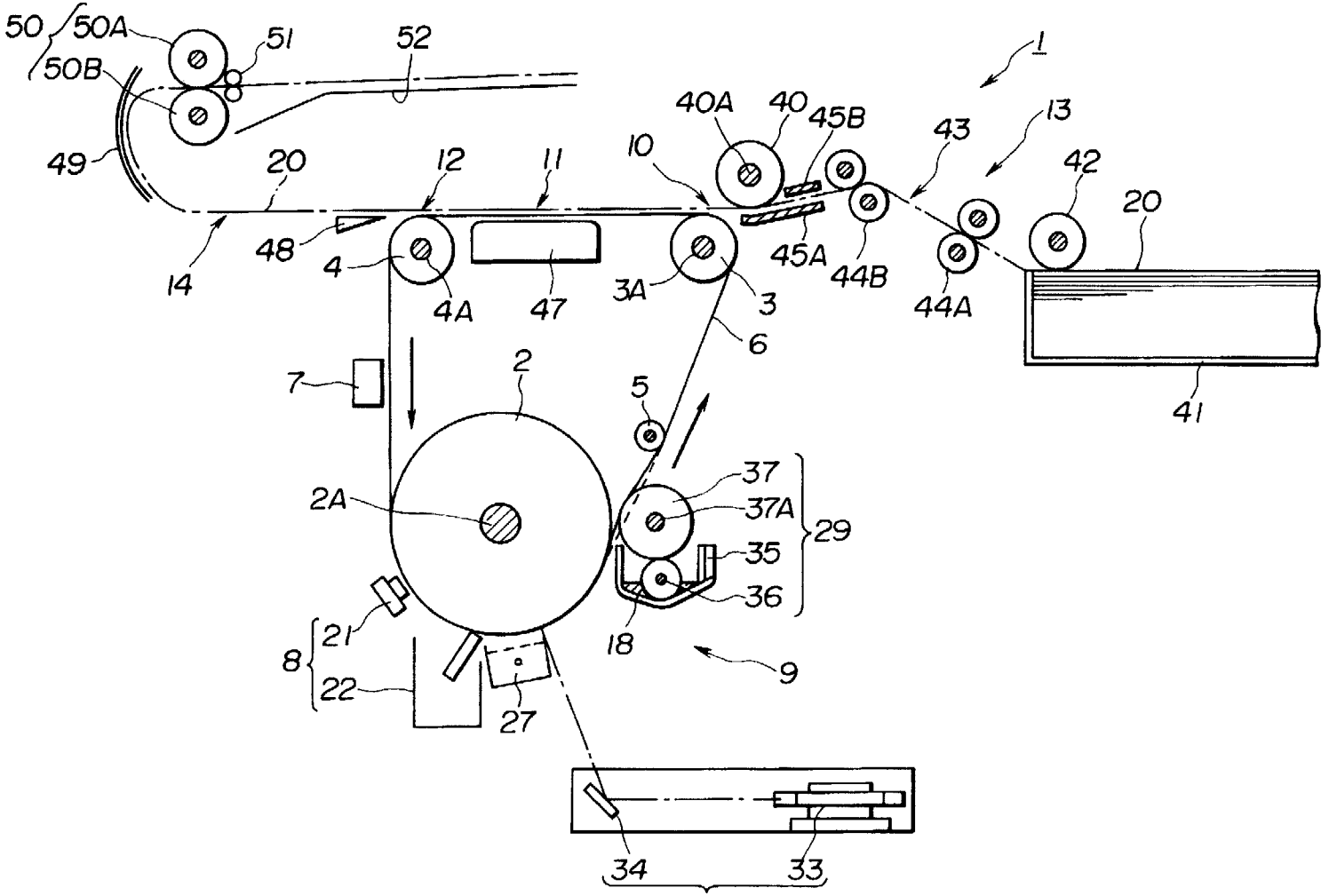
FIG. 1 is a view showing the fundamental configuration of an image forming apparatus according to this invention.

More practical embodiments of this invention will be described below in detail. An embodiment image forming apparatus 1 is an apparatus for forming an image (pictorial image) on a recording sheet 20, etc. by the electrophotographic process on the basis of a picture (pictorial image) information signal read by means of a scanner, etc., and has the feature with respect to the configuration of using an endless belt-shaped photosensitive member 6 and a solidified developer 18. The image forming apparatus 1 includes the endless belt-shaped photosensitive member 6 laid across a group of plural guide rollers 2 to 5 and caused to undergo endless traveling whereby. The image forming apparatus 1 is of a structure in which a position detecting section 7, a cleaning mechanism section 8, an image preparation process section 9, a recording sheet contact section 10, a cooling section 11, and a recording sheet peeling section 12 are disposed respectively in order along the traveling path of the endless belt-shaped photosensitive member 6.

Moreover, the image forming apparatus 1 is of a structure in which a recording sheet supply section 13 for delivering the recording sheet 20 onto the traveling endless belt-shaped photosensitive member 6 is disposed in a manner located at the side portion of the recording sheet connection section 10, and a recording sheet ejecting section 14 from which recording sheet 20 is ejected is disposed in a manner located at the side portion of the recording sheet peeling section 12.

Figure 2:
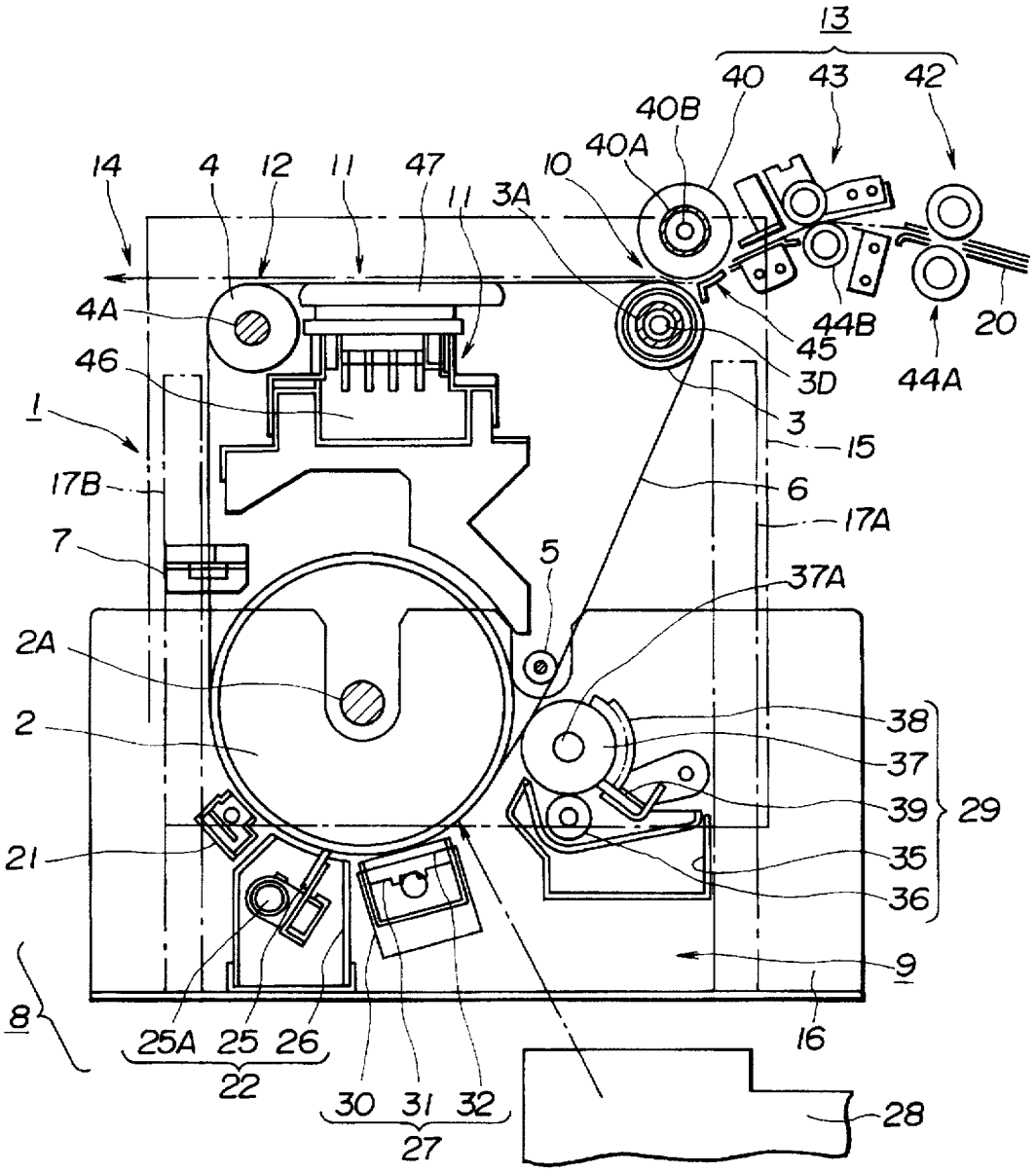
FIG. 2 is a side view for explaining the essential part of the image forming apparatus.
Figure 3:
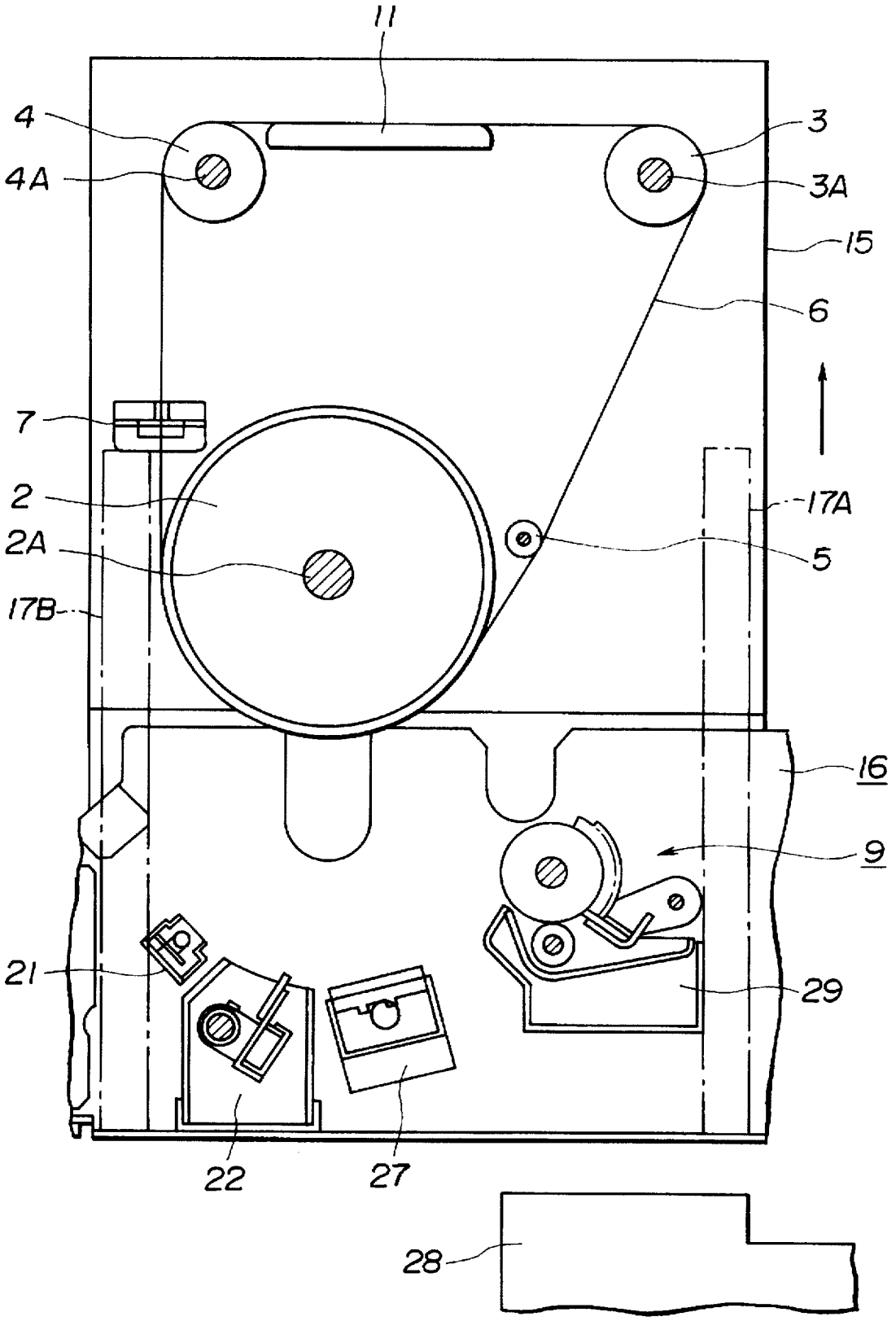
FIG. 3 is an essential part side view for explaining the state where sub-frame is pulled up in the image forming apparatus.

Further, the image forming apparatus 1 includes within the apparatus casing (not shown), a movable frame 15 constituted by a pair of opposite side plates in which a group of guide rollers 2 to 5 across which the endless belt-shaped photosensitive member 6 lies, and a base frame 16 in which respective mechanisms constituting the image preparation process section 9 are disposed. On the base frame 16, guide members 17 (17A, 17B) for vertically movably supporting the movable frame 15 in upper and lower directions in FIG. 2 are disposed.

In the image forming apparatus, although the detail will be described later, recording sheet 20 is delivered at the traveling path portion in a horizontal direction of the endless belt-shaped photosensitive member 6 constituted between the recording sheet contact roller 3 and the recording sheet peeling roller 4. Thus, transfer operation onto the recording sheet 20 of the developer image 18A formed on the surface of the endless belt-shaped photosensitive member 6 is carried out at the image preparation process section 9. Generally, in the image forming apparatus there are instances where in the traveling process of the recording sheet 20, such recording sheet 20 is clogged, so jam phenomenon, etc. takes place. In the image forming apparatus, as described above, recording sheet 20 is traveled only at the traveling path portion in a horizontal direction of the endless belt-shaped photosensitive member 6 positioned at an upper portion of the drive roller 2. Accordingly, in the image forming apparatus 1, in the case where clogging phenomenon, etc. of recording sheet 20 takes place, the movable frame 15 is pulled up from the base frame 16 along the guide member 17. Thus, recording sheet which has been clogged within the traveling path is easily removed without affecting the image preparation process section 9.

The endless belt-shaped photosensitive member 6 is of a structure in which a photosensitive layer comprised of an organic photoconductor or inorganic photoconductor is formed on the surface of a conductive base which has an abrasion resistance property and mechanical characteristic and has flexibility, and constitutes an endless belt by connecting the initial end and the terminating end of the belt of a width dimension slightly greater than at least the width dimension of the recording sheet 20. As an organic photoconductor constituting the photosensitive layer, there are enumerated, e.g., electrophotographic photosensitive base material consisting of poly-N-vinylcarbazole and 2,4,7-trinitrofluorene-9-on, material obtained by sensitizing poly-N-vinylcarbazole by pyrylium salt system coloring matter, material obtained by sensitizing poly-N-vinylcarbazole by cyanine coloring matter, electrophotographic photosensitive base material including organic pigment as major component, and/or electrophotographic photosensitive base material including, as major component, crystal complex consisting of dye and resin, etc. In addition, as inorganic photoconductor constituting the photosensitive layer, there are enumerated zinc oxide, zinc sulfide, cadmium sulfide, selenium, selenium-tellurium alloy, selenium-arsenic alloy, selenium-tellurium-arsenic alloy, and/or non-crystalline silicon system material, etc.

In this image forming apparatus 1, there is used a solidified developer 18 where development particles are dispersed in a dispersion medium, which is solid at an ordinary temperature, and is molten by heating and is re-solidified by cooling. The dispersion medium of the solidified developer 18 is an electric insulating organic material, and its melting point is caused to be above 30° C. by taking the ordinary use environment and operability, etc. into consideration, and is caused to be more preferably above 40° C. The upper limit of the melting point of the dispersion medium is not particularly prescribed. However, with respect to solidified developer 18, in the case where melting point of the dispersion medium is too high, a large thermal source for heating and fusing the solidified developer 18 is required, giving rise to the problems that power consumption becomes great, and it is necessary to allow for the heat resisting temperatures of respective members used as the apparatus constituent members, and/or the cooling time of the solidified developer 18 is elongated so that the processing speed for forming the image becomes low, etc. Accordingly, as the dispersion medium, there is selected a material having melting point less than 100° C. from a viewpoint of practical use, and preferably less than 80° C.

As the material which satisfies the above-described condition of the dispersion medium, paraffin, wax and or mixed material thereof are enumerated. As the paraffin, e.g., various normal paraffin having the number of carbons of 19 to 80 from nonadecane to hexacontane are enumerated. As the wax, vegetable wax such as carnauba wax, or cotton wax, etc., animal wax such as bees wax, etc., ozocerite and paraffin wax, micro-crystal wax, petroleum wax such as petrolatum, etc. are enumerated. These materials are dielectric material generally having dielectric constant $\epsilon$ of about 1.9 to 2.3. For the purpose of improving, the condensation factor, ethylene-vinyl acetate copolymer, etc. may be added to the dispersion medium. As the dispersion medium, there can be also used crystalline high molecule, etc. having long alkyl group at the side chain of homo-polymer or copolymer (e.g., copoly-n-stearyl acrylate-ethyl methacrylate, etc.) of polyacrylate such as polyethylene, polyacryl amide, poly-n-stearyl acrylate, poly-n-stearyl methacrylate, etc.

With respect to the solidified developer 18, as a coloring agent particle (developer particle) dispersed in the above described dispersion medium, inorganic pigment, organic pigments dye or mixed material thereof are used. As the inorganic pigment, e.g., chromium system pigment, cadmium system pigment, iron system pigment, cobalt system pigment, ultramarine, iron blue, etc. are enumerated. As the organic pigment, or dye, there are enumerated Hansa Yellow (C. 1. 11680), benzine yellow G (C. 1. 21090), benzine orange (C. 1. 21110), Fast Red (C. 1. 37085), Brilliant Carmine 3B (C. 1. 16015-Lake), Phthalocyanine Blue (C. 1. 74160), Victoria Blue (C. 1. 42595-Lake), spirit black (C. 1. 50415), oil blue (C. 1. 74350), Alkali Blue (C. 1. 42770-A), Fast Scarlet (C. 1. 12315), rhodamine lake (C. 1. 45160-Lake), Fast Sky Blue (C. 1. 74200-Lake), Nigrosine (C. 1. 50415) and/or carbon black, etc. Such organic pigment or dye is used individually, or as a mixture including two kinds of materials or more, and is selected in order to present desired coloring.

For the solidified developer 18, in addition to the above-described dispersion medium or coloring agent particle, resin may be commonly used in order to improve dispersion property or electrification property of the coloring agent particle. As resin to be mixed, there are enumerated, e.g., rubber family such as butadiene rubber, styrene-butadiene rubber, cyclized rubber and/or natural rubber, etc., synthetic resin such as styrene system resin vinyltoluene system resin, acryl system resin, methacrylic system resin, polyester system resin, polycarbonate system resin, or polyvinyl acetate system resin, etc., rosin system resin, hydrogenated rosin system resin, alkyd resin family including denaturated alkyd such as linseed oil denaturated alkyd resin, etc., and/or natural resin such as polyterpene, etc. Moreover, as resin to be mixed, other phenol resin family, denaturated phenol resin family such as phenol formalin resin, etc., pentaerythritol phthalate, coumarone-indene resin family, ester gum resin family, and/or vegetable oil polyamide resin family, etc. are also effective. Further, as resin to be mixed, halogenated carbon-hydrogen polymer family such as polyvinyl chloride, or chlorinated polypropylene, etc., synthetic rubber family such as vinyltoluene-butadiene, butadiene-isoprene, etc., polymer of acrylic system monomer having long chain alkyl group such as 2-ethylhexyl methacrylate, lauryl methacrylate, stearyl methacrylate, lauryl acrylate, or octyl acrylate, etc., or copolymer family of those polymers and other polymeric monomer, e.g., stylene-lauryl methacrylate copolymer, acrylic acid-lauryl methacrylate copolymer, etc., polyolefin family such as polyethylene, etc., or polyterpene family, etc. can be used.

Charge donating agent is added to the solidified developer 18. As the charge donating agent, e.g., metal salt of fatty acid such as naphthenic acid, octenic acid, stearic acid, isostearic acid, etc. oil soluble sulphonic acid metal salt, aromatic carboxylic acid metal salt, and/or aromatic sulphonic metal salt, etc. can be used. Further, in order to improve the electrification charge of the above-described coloring agent particle, e.g., metal oxide particle such as $SiO_2$, $Al_2O_2$, $TiO_2$, ZnO, $Ga_2O_3$, $GeO_2$, $In_2O_3$, $SnO_2$, $PbO_2$, MgO, etc. or a charge enhancement agent consisting of a mixture thereof is added to the solidified developer 18.

As the recording sheet 20, there is used sheet body of material having an excellent adhesive characteristic with respect to the solidified developer 18, and various sheet bodies are diversely selected depending upon use purpose. As the recording sheet 20, there is used a sheet body using, as material, e.g., various papers such as natural paper or synthetic paper, etc., cloth or nonwoven cloth consisting of vegetable fiber such as cotton or hemp, etc., or animal fiber such as silk or wool, etc., close or nonwoven cloth consisting of organic synthetic fiber such as polyamide, polyester, polyacetal or polyurethane, or inorganic fiber such as ceramic or carbon, etc., mesh such as metal or organic high molecule, etc. or high molecule foam body such as polyurethane foam, etc. With respect to the recording sheet 20, in order to preserve it in a form of ordinary document, paper of white, etc. is used by taking visibility into consideration, but the recording sheet is not limited to such white paper.

Figure 8:
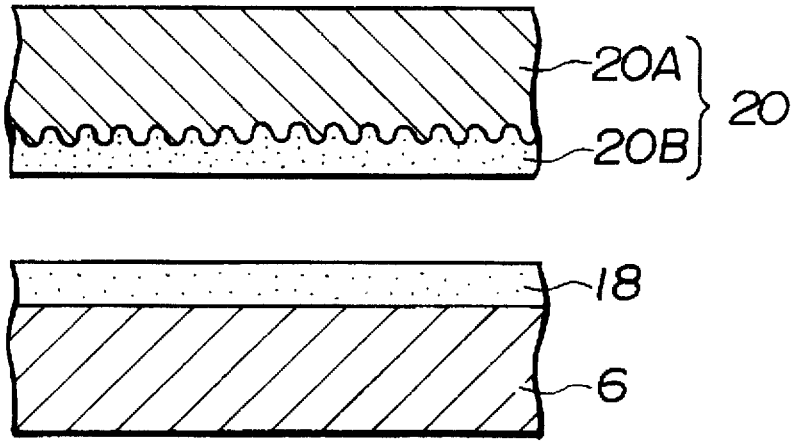
FIG. 8 is an essential part longitudinal cross sectional view for explaining the configuration of endless belt-shaped photosensitive member in which developer image is formed on the surface thereof, and recording sheet.

In the recording sheet 20, in order to improve adhesive force with respect to the solidified developer 18, as shown in FIG. 8, a resin layer 20B compatible with the dispersion medium of the above-described solidified developer 18 is formed on a base 20A. As resin for forming the resin layer plastic elastomer, ionomer resin, vinyl acetate copolymer polyolefin, low molecular weight polyolefin and/or adhesive agent for hot melt, etc. can be used.

The group of guide roller 2 to 5 for allowing the endless belt-shaped photosensitive member 6 to undergo endless traveling are composed of a drive roller 2 having a length dimension sufficient to support the endless belt-shaped photosensitive member 6 over the entirety in a width direction, a recording sheet contact roller 3, a recording sheet peeling roller 4, and a backing roller 5, etc. It is to be noted that it is a matter of course that they are disposed not only as indicated by the above-described respective guide rollers 2 to 5, but also are suitably disposed in a manner positioned on the inner circumferential side or the outer circumferential side of the traveling path of the endless belt-shaped photosensitive member 6.

The drive roller 2 is a guide roller in which the outer circumferential surface is formed as a smoothing surface, and the diameter dimension is 100 mm, and is rotatably supported by a support shaft 2A supported and mounted on a movable frame 15. Moreover, the drive roller 2 is rotationally driven in a counterclockwise direction in FIG. 1 by a drive motor (not shown). The drive roller 2 supports the inner circumferential side of the endless belt-shaped photosensitive member 6 by the outer circumferential portion of the lower side thereof 2 thereby to travel it in a manner to prevent occurrence of loosening, etc. and in a stable state.

The recording sheet contact roller 3 and the recording sheet peeling roller 4 are of a structure in which the outer circumferential surface is similarly formed as a smoothing surface and the diameter dimension is about 30 mm, and serves as a guide roller of small diameter with respect to the drive roller 2. The recording sheet contact roller 3 and recording sheet peeling roller 4 are respectively supported by support shafts 4A supported and mounted on the movable frame 15. The recording sheet contact roller 3 and the recording sheet peeling roller 4 are positioned at an upper portion of the drive roller 2, and are disposed so that respective portions of the outer circumferential surface of the upper side mutually constitute substantially the same plane.

Figure 4:
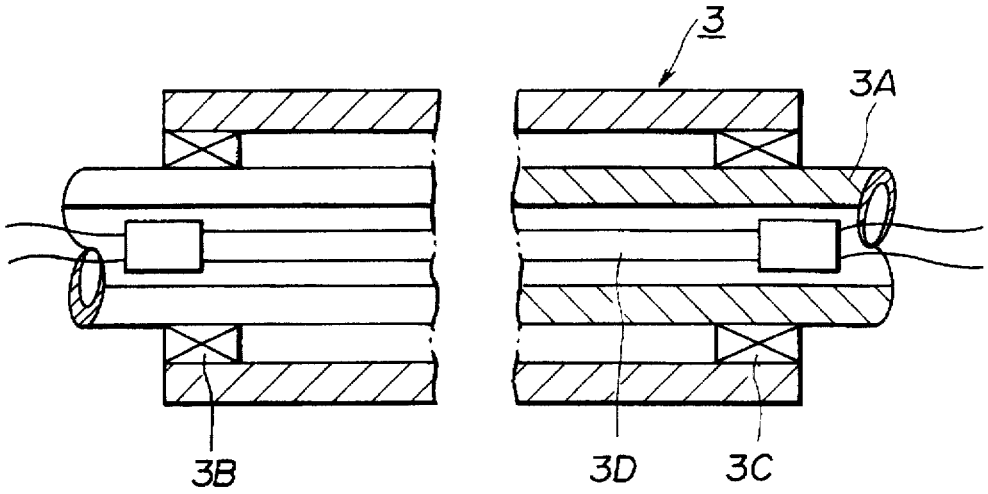
FIG. 4 is an essential part longitudinal cross sectional view for explaining the configuration of a recording sheet contact roller provided in the image forming apparatus and including heating means therein.
Figure 5:
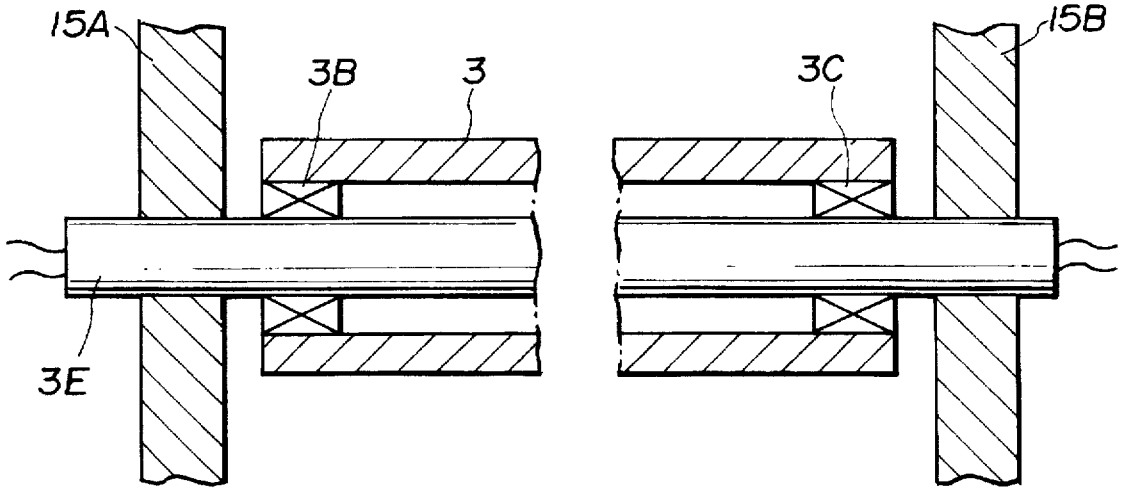
FIG. 5 is an essential part longitudinal cross sectional view showing another embodiment of the recording sheet contact roller including heating means therein.

The recording sheet contact roller 3 is formed tubular as a whole as shown in FIG. 4, and is rotatably supported by a pair of bearing members 3B, 3C on a support shaft 3A disposed at the movable frame 15 in the state positioned at the outside of the upper portion with respect to the drive roller 2. The support shaft 3A is formed tubular as a whole by a metal material, etc. which is satisfactory in thermal conductivity and is sufficient in the mechanical strength, and is supported and mounted at the both ends thereof by the movable frame 15. Within the support shaft 3A, heating means 3D comprised of, e.g., halogen heater, etc. is disposed. This heating means 3D has a length dimension substantially equal to the length dimension of the recording sheet contact roller 3, and uniformly heats the recording sheet contact roller 3 through the support shaft 3A from the internal side thereof so that its temperature is more than the melting point of the dispersion medium of the solidified developer 18. Accordingly, the recording sheet contact roller 3 uniformly heats the endless belt-shaped photosensitive member 6 traveling on the outer circumferential portion over the entire area in a width direction to hold the molten state of the dispersion medium of the solidified developer 18 which then forms a developer image 18A on the surface of the endless belt-shaped photosensitive member 6.

While the heating means 3D of the recording sheet contact roller 3 is not limited to the above-described structure, such heating means may be constituted by heating means 3E comprised of a heater member formed axial. Namely, the heater member constituting the heating means BE is supported and mounted at the both ends thereof by movable frames 15A, 15B and is adapted to directly rotatably support the recording sheet contact roller 3 through bearings 3B, 3C. In other words, the heater member serves as both the support shaft of the recording sheet contact roller 3 and the heating means.

As stated above, in the image forming apparatus 1, heating means 3D or 3E is disposed within the recording sheet contact roller 3 to thereby uniformly heat the endless belt-shaped photosensitive member 6 over the entire area in a width direction to hold the solidified developer 18 so that it is in the molten state, and to improve space efficiency of the apparatus without constituting hindrance to the traveling of the endless belt-shaped photosensitive member 6 or the recording sheet 20.

It is a matter of course that the heating means of the recording contact roller 3 may be a heater member of the panel type disposed at the outer circumferential portion of the recording sheet contact roller 3. However, it is necessary to provide such a panel type heater member in the range which does not constitute hindrance to the traveling path of the endless belt-shaped photosensitive member 6 or the recording sheet 20. Accordingly, there is the problem that it is difficult to sufficiently heat the recording sheet contact roller 3.

The recording sheet peeling roller 4 is disposed so that a portion of the -outer circumferential surface of the lateral direction thereof constitute substantially the same plane with respect to the drive roller 2. The endless belt-shaped photosensitive member 6 is laid upon the drive roller 2, the recording sheet contact roller 3 and the recording sheet peeling roller 4 so that a traveling path in a right (angled) triangular shape directed substantially downward is constituted. Thus, the endless belt-shaped photosensitive member 6 is caused to undergo endless traveling. Namely, after the endless belt-shaped photosensitive member 6 is turned back in a direction ascending to the right (hereinafter simply referred to as a right ascending direction) by the drive roller 2 and is traveled toward the recording sheet contact roller 3 side, it is turned back in a horizontal direction by the recording sheet contact roller 3 and is traveled toward the recording sheet peeling roller 4. Further, the endless belt-shaped photosensitive member 6 is turned back in a vertical direction by the recording sheet peeling roller 4 and is traveled toward the drive roller 2.

The backing roller 5 is positioned at the right ascending traveling path portion of the endless belt-shaped photoconductive body 6 constituted between the drive roller 2 and the recording sheet contact roller 3, and is disposed in the state rotatably supported by support shaft 5A supported and mounted on the movable frame 15. In this backing roller 5, the outer circumferential surface for supporting the internal surface of the endless belt-shaped photoconductive body 6 is formed as a smoothing surface. The backing roller 5 is a guide roller provided so that the endless belt-shaped photosensitive member 6 traveling between the drive roller 2 and the recording sheet connection roller 3 can be traveled in a stable state, and serves so that development processing with respect to the endless belt-shaped photosensitive member 6 by development section 29 which will be described later, constituting the image preparation process section 8 disposed at the traveling path portion can be stably carried out.

The position detecting section 7 is disposed at the traveling path in a vertical direction between the recording sheet peeling roller 4 and the drive roller 2. The position detecting section 7 constitutes, although its detail is omitted, detecting means, e.g., by a light emitting element and a light receiving element oppositely disposed with the endless belt-shaped photosensitive member 6 being put therebetween. The position detecting section 7 optically detects that a quantity of light which is irradiated from the light emitting element to the endless belt-shaped photosensitive member 6 and is received by the light receiving element varies at the joint portion between the initial end and the terminating end of the endless belt-shaped photosensitive member 6 to send out a detection output to a control section. In this image forming apparatus 1, control of the start operation of image formation or supply operation of recording sheet 20, etc. by the image preparation process section 9 with respect to the endless belt-shaped photosensitive member 6 is carried out from the control section by an output of the position detecting section 7.

It is to be noted that it is a matter of course that the position detecting section V may be provided at any portion of the traveling path of the endless belt-shaped photosensitive member 6. Moreover, the detecting means may be constituted, in addition to the above-described transmission type optical detecting means, by reflection type optical detecting means in which a light emitting element and light receiving element are disposed at the same side surface portion with respect to the endless belt-shaped photosensitive member 6. In addition, mechanical detecting means, etc. may be employed.

In the image forming apparatus 1, a cleaning mechanism section 8 and the image preparation process section 9 are disposed in order with respect to the rotational direction along the outer circumferential portion of the lower side portion of the drive roller 2 for supporting the endless belt-shaped photosensitive member 6 to allow it to be traveled in a stable manner. The cleaning mechanism section 8 and image preparation process section 9 are disposed and supported at the base frame 16 side.

The cleaning mechanism section 8 is composed of a static charge eliminator (reducer) 21 and a blade mechanism 22 disposed in order with respect to the traveling direction of the endless belt-shaped photosensitive member 6. The cleaning mechanism section 8 eliminates, by a static charge eliminator 21, minus charges electrified on the surface of the electrified endless belt-shaped photosensitive member 6 in the former image forming process thereafter scrapes away the solidified developer 18 remaining on the surface of the endless belt-shaped photosensitive member 6 by the blade mechanism 22 to allow the endless belt-shaped photosensitive member 6 to be in an initial state.

The static charge eliminator 21 is constituted by a static charge eliminating lamp generally installed in the electrophotographic process. The static charge eliminator 21 irradiates light onto the surface of the endless belt-shaped photosensitive member 6 to thereby uniformly eliminate minus charges which serve as the electrostatic adhesive force of the solidified developer 18 electrified on the surface thereof.

The blade mechanism 22 is composed, as shown in FIG. 2, of a blade 25 caused to be forced onto the surface of the endless belt-shaped photosensitive member 6 to which static charge elimination processing of minus charges has been implemented by the static charge eliminator 21, and a vessel 28 for gathering solidified developer 18 scraped away from the surface of the endless belt-shaped photoconductive body 8 by the blade 25, and the like. The blade 25 is formed by a material, e.g., hard rubber, etc. which is caused to slightly have flexibility so that the surface of the endless belt-shaped photosensitive member 6 is not damaged. The blade 25 has a width dimension which can be in pressure contact, over the entire area in a width direction, with the endless belt-shaped photosensitive member 6. Moreover, the blade 25 is supported on a supporting portion 25A by a structure which can adjust pressure contact force with respect to the endless belt-shaped photosensitive member 6. Accordingly, the blade mechanism 22 allows the blade 25 to come into collision (contact), by suitable contact pressure force, with the surface of the endless belt-shaped photosensitive member 6 on which the minus charges on the surface have been eliminated by the static charge eliminator 21 and to scrape away the remaining solidification developer 18 into the vessel 28 from the surface of the endless belt-shaped photosensitive member 6.

The vessel 28 is assembled into the base frame 16 so that it can be drawn in order to carry out disposal of the solidified developer 18 remaining therein. Additionally, the bleed 25 may be of a structure in which it is replaced by other mechanical cleaning means such as fur brush or magnetic toner, etc.

The endless belt-shaped photosensitive member 6 is caused to undergo, at the cleaning mechanism section 8, elimination of minus charges electrified on the surface and cleaning processing of the remaining solidified developer 18, and is then traveled to the image preparation process section 9 of the next stage in the state supported by drive roller 2, at which formation of image is carried out on the surface. This image preparation process section 9 is composed of an electrification charger 27 constituting electrification means, a laser optical system 28 constituting exposure means, and a development section 29, etc.

The electrification charger 27 is a unit for electrifying, e.g., minus charges on the surface of the endless belt-shaped photosensitive member 6. In the image forming apparatus 1, a scorotron for uniformly implementing electrification processing is employed. This scorotron is of a structure, as shown in FIG. 2, in which a discharge wire 31 for producing corona discharge is disposed within a charger casing 30 of which the opening portion is formed substantially opposite to the surface of the endless belt-shaped photosensitive member 6, and a mesh 32 functioning as a grid electrode is disposed at the opening portion. The scorotron is adapted so that when a voltage applied to the discharge wire 31 is gradually increased so that an electric field is above a critical value, corona discharge is produced from the discharge wire 31 to allow minus charges to be electrified in a uniform state over the entirety of the surface of the endless belt-shaped photoconductive body 6 by action of the mesh 32 of the opening portion.

The laser optical system 28 is disposed, as shown in FIG. 2, in a horizontal direction at a lower part of the base frame 16, and is composed, as shown in FIG. 1, of a semiconductor laser light source 33 for emitting laser beams, an optical system such as a reflection mirror 34 for guiding laser beams onto the surface of the endless belt-shaped photosensitive member 6, or a condensor lens (not shown) disposed between the semiconductor laser light source 33 and the reflection mirror 34 and adapted to carry out spot irradiation of laser beams onto the surface of the endless belt-shaped photosensitive member 6, etc. and the like. The laser optical system 28 is operated in accordance with a picture information signal sent out from the control section (not shown) to scan the surface of the endless belt-shaped photosensitive member 6 by laser beams emitted from the semiconductor laser light source 33 through the optical system. When laser beams are irradiated onto the endless belt-shaped photosensitive member 6, the surface thereof is exposed to light, and minus charges electrified in the exposed portion are eliminated so that an electrostatic latent image corresponding to the picture (pictorial) image information signal is formed.

It is to be noted that, with respect to the write operation of the picture information signal onto the surface of the endless belt-shaped photosensitive member 6, employment of so called light emitting diode printer system using, e.g., a light emitting array as a light source can be made in addition to the above-described laser optical system 28.

After an electrostatic latent image is formed on the surface in the laser optical system 28, the endless belt-shaped photoconductive body 8 is traveled toward the developing section 29 disposed at the next stage in the state supported by the outer circumferential portion of the drive roller 2, at which development processing of the electrostatic latent image is implemented. The developing section 29 is composed of a heat resisting vessel (tray) 35 to which the substantially solidified developer 18 is supplied, a developer supply roller 36, a development roller 37, a heater 38 for heating the development roller 37, a blade 39 for removing excess solidified developer 18 attached on the development roller 37, and the like.

In the developing section 29, as described above, the solidified developer 18 which is solid at an ordinary temperature and is adapted so that fusing and solidification are repeated by implementing heating/cooling is used. The solidified developer 18 caused to be in a molten state is delivered to the surface of the endless belt-shaped photosensitive member 6 to form a developer image 18A corresponding to the picture information signal from an electrostatic latent image. As the result of the fact that the solidified developer 18 is delivered into the heat resisting vessel 35 in a solid state, dispersion medium is molten by heater (not shown) disposed at the heat resisting vessel 35. Developer particles electrified so that plus charges result are dispersed in the solidified developer 18 in molten state.

The developer supply roller 36 is rotatably supported within the heat resisting vessel 35 in the state where a portion of the circumferential surface is infiltrated in the molten solidified developer 18. Since the developer supply roller 36 uniformly comes into pressure contact, over the entire area in width direction, with the developer roller 37, it is formed by, e.g., slightly soft rubber, etc. The development roller 37 is a roller of metal or resin to which metal plating, etc. is implemented in order to provide an abrasion resisting property, and is supported by support shaft 37A supported and mounted on the base frame 16. The development roller 37 is rotationally driven in the state where it is in pressure contact with the circumferential surface of the developer supply roller 36, and is in pressure contact with the surface of the endless belt-shaped photosensitive member 6 between the drive roller 2 and the backing roller 5. Thus, the development roller 37 is rotationally driven in a clockwise direction in FIG. 2. The developer supply roller 36 and developer roller 37 respectively have length dimensions which can come into pressure contact, over the entire area in width direction, with the endless belt-shaped photosensitive member 6.

With respect to the developer roller 37, for a time period during which solidified developer 18 is delivered from the developer supply roller 36 to the endless belt-shaped photosensitive member 6, heating processing is implemented by the heater 38 so that the solidified developer 18 is not re-solidified. The heater 38 is constituted with a panel heater, circular arc shaped in cross section, which extends over the entire area in an axial direction of the outer circumferential portion of the development roller 37, and heats the development roller 37 so that its temperature is above the melting point of the solidified developer 18. It is to be noted that it is a matter of course that the heating means of development roller 37 is not limited to the above-described heater 38, but such heating means may be constituted, e.g., by halogen heater, etc. in an axial form disposed within the support shaft of the development roller 37. It is preferable that the heater 38 is constituted so as to uniformly heat the development roller 37 over the entire area in an axial direction.

The blade 39 is disposed at the position of the next stage of the heater 38 with respect to rotational direction at the outer circumferential portion of the development roller 37. The blade 39 is formed by a material, e.g., hard rubber, etc. caused to have a slight flexibility so that the surface of the development roller 37 is not damaged. The blade 39 has a width dimension which can come into pressure contact, over the entire area in width direction, with the development roller 37, and is supported on the support portion by a structure such that the contact pressure force can be adjusted with respect to the development roller 37.

In the developing section 29 constituted in a manner described above, solidified developer 18 molten within the heat resisting vessel 35 is delivered to the surface of the development roller 37 through the developer supply roller 36, and is further delivered from the development roller 37 onto the surface of the endless belt-shaped photosensitive member 6. In this case, the endless belt-shaped photosensitive member 6 is composed, as described above, of an electrostatic latent image portion from which minus charges are eliminated in the laser optical system 28 and a back ground portion in which minus charges remain. On the other hand, in the solidified developer 18 in a molten state delivered from the development roller 37 onto the surface of the endless belt-shaped photosensitive member 6, developer particles electrified so that plus charges result are dispersed. Accordingly, the solidified developer 18 is placed in the state where it has no electrostatic coupling force in the electrostatic latent image portion, and is attached on the surface of the endless belt-shaped photosensitive member 6 with a strong electrostatic coupling force at other portions. In other words, a developer image portion 18A having plus charges are formed in correspondence with the electrostatic latent image on the endless belt-shaped photosensitive member 6. The excess solidified developer 18 attached to the development roller 36 is scraped away by blade 39. Accordingly, a fixed quantity of solidified developer 18 is delivered from the developer supply roller 36 to the development roller 37.

Figure 6:
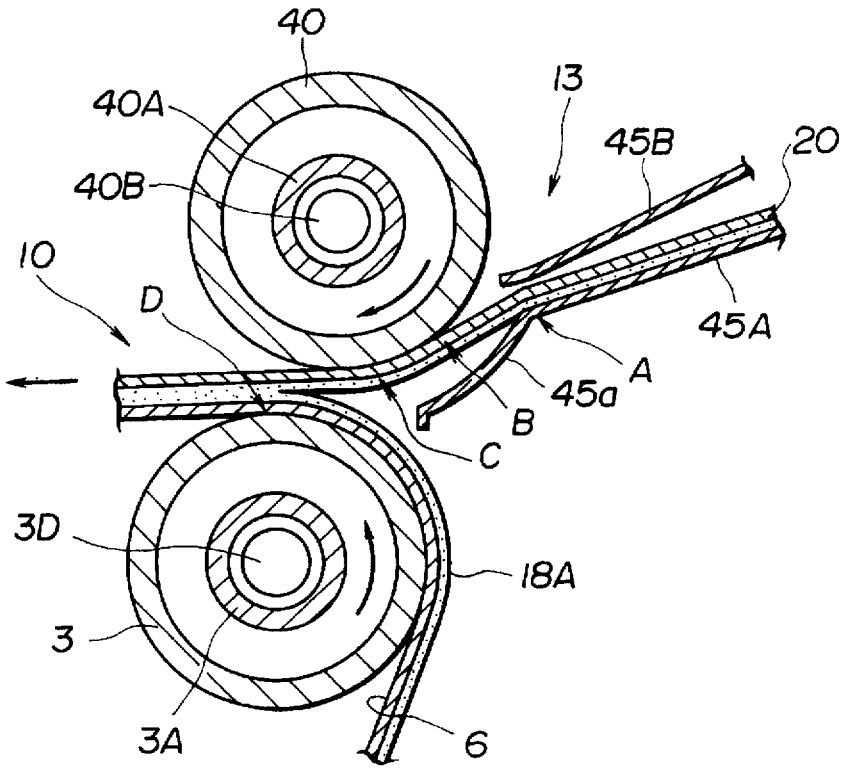
FIG. 6 is an essential part longitudinal cross sectional view for explaining the configuration of a recording sheet contact portion for traveling recording sheet delivered from recording sheet supply section to recording sheet contact roller in a manner laid upon the endless belt-shaped photosensitive member in the image forming apparatus.

After the above-described developer image 18A is formed by the developing section 29, the endless belt-shaped photosensitive member 6 is caused to undergo travel-driving, and is turned back in a horizontal direction at the recording sheet contact roller 3 and is traveled. However, as shown in FIG. 6, recording sheet 20 delivered from the recording sheet supply section 13 is laid upon the surface of the endless belt-shaped photosensitive member 6 at the turn-back portion. As stated above, the recording sheet contact roller 3 constitutes a recording sheet contact portion 10 in which the recording sheet 20 is laid upon the endless belt-shaped photosensitive member 6.

The recording sheet supply section 13 is composed of a recording sheet supply roller 40 supported by a support shaft 40A disposed in a manner positioned slightly at the outside of the upper portion with respect to the recording sheet contact roller 3, a recording sheet sending-out mechanism 42 of which detail is omitted for sending out, one by one, contained recording sheets 20 from a recording sheet cassette 41, and a recording sheet guide mechanism 43 for carrying (conveying) the sent out recording sheets 20 to the recording sheet contact section 10.

The recording sheet cassette 41 accommodates a large number of recording sheets 20 in a stacked manner to permit loading or taking-out thereof with respect to the cassette loading section of which illustration is omitted. At the recording sheet cassette 41, although illustration is omitted, a recording sheet pushing (thrusting) up mechanism comprised of an elastic (resilient) member, etc. and adapted for upwardly pushing up the accommodated recording sheets 20 is provided at the bottom portion. It is to be noted that it is a matter of course that while the recording sheet cassette 41 is illustrated as a single cassette body in the image forming apparatus 1, there may be employed a configuration in which a plurality of cassette loading sections are provided so that plural recording sheet cassettes of different sizes are loaded.

The recording sheet sending out mechanism 42 is composed of a plurality of supply paper rollers, etc. positioned and disposed in correspondence with the loading opening portion of the cassette loading section. These supply paper rollers are disposed, as shown in FIG. 1, in the state positioned at the upper portion of the loading side of the recording sheet cassette 41 loaded into the cassette loading section, and is in pressure contact with the recording sheet 20 of the uppermost portion. The recording sheet sending out mechanism 42 is adapted so that the supply paper roller is rotationally driven in a clockwise direction in FIG. 1 by a supply paper signal sent out from the control section, whereby this mechanism 42 sends out, one by one, recording sheets 20 from the recording sheet cassette 41 to the recording sheet guide mechanism 43.

The recording sheet guide mechanism 43 is composed of members such as plural sets of guide roller mechanism 44 (44A, 44B) respectively constituted by pairs of upper and lower guide rollers, a pair of upper and lower guide plate members 45 (45A, 45B) disposed between the guide roller mechanisms 44 and the recording sheet supply roller 40, and the like. Guide rollers constituting the guide roller mechanism 44 are formed by elastic material such as rubber, etc. having elasticity and abrasion resisting property, etc., and are rotationally driven in the state where they are in pressure contact with each other, whereby they carry (convey) recording sheet 20 in the state put therebetween. A lower side guide plate member 45A is of a structure as shown in FIG. 6 in which the front end portion 45a is bent downward at the position A slightly spaced relative to the recording sheet supply roller 40, the entirety thereof is in circular arc form in cross section along the outer circumferential portion of the recording sheet supply roller 40, and is extended in proximity of the outer circumferential portion of the recording sheet contact roller 3.

The first guide roller mechanism 44A of the recording sheet guide mechanism 43 constitutes a recording sheet traveling path for carrying (conveying) the recording sheet 20 in a direction ascending to the left (hereinafter simply referred to as a left ascending direction) from the recording sheet cassette 41 as shown in FIG. 1. Moreover, the guide plate member 45 guides the recording sheet 20 which has been carried (conveyed) by the second guide roller mechanism 44B in a manner to allow it to come into collision (contact) with the outer circumferential portion of the lower side of the recording sheet supply roller 40. In this case, the recording sheet 20 is caused to come into collision with the outer circumferential portion of the lower side of the recording sheet supply roller 40 of FIG. 8 at the position B thereof. This colliding (contact) position B is caused to be shifted slightly to the recording sheet supply portion 13 side relative to the lowermost side position C of the recording sheet supply roller 40.

The recording sheet 20 is pushed by the second guide roller mechanism 44B and is further traveled. Thus, the recording sheet 20 is traveled in a manner laid upon the surface of the endless belt-shaped photosensitive member 6 supported by the recording sheet contact roller 3. For this reason, the recording sheet 20 is traveled in a manner to be in contact with the outer circumferential portion between the colliding position B and the lowermost side position C with respect to the recording sheet supply roller 40. Eventually, the recording sheet 20 will be traveled in such a manner that it is laid upon the endless belt-shaped photosensitive member 6 at the position D on a vertical line passing through the support shaft 40A of the recording sheet supply roller 40. Accordingly, the recording sheet 20 is curved between the colliding position B and the lowermost side position C, whereby this recording sheet 20 is caused to be tightly in contact with the recording sheet connection roller 3 by a very small contact pressure force produced by the its own rigidity.

As stated above, in the image forming apparatus 1, the configuration of the recording sheet contact roller 3, the recording sheet supply roller 40 and the recording sheet guide mechanism 43 allows particularly the mechanism for causing the recording sheet 20 to come into pressure contact with the endless belt-shaped photosensitive member 6 to become unnecessary, and these members are tightly in contact with the recording sheet 20 by very small contact pressure force. Accordingly, in the image forming apparatus 1, the contact pressure mechanism is caused to become unnecessary, whereby simplification of the structure is realized. In addition, collapse phenomenon, etc. of the transfer image produced resulting from the fact that the recording sheet 20 is caused to come into pressure contact with the surface of the endless belt-shaped photosensitive member 6 by excessive contact pressure force by the contact pressure application mechanism is prevented. Thus, transfer image in a satisfactory state can be obtained.

The recording sheet supply roller 40 is formed tubular by elastic material such as rubber, etc. As shown in FIG. 6, heating means 40B for heating the recording sheet 20 so that its temperature is above the melting point of the dispersion medium of the solidified developer 18 is disposed within the recording sheet supply roller 40. The recording sheet supply roller 40 provided with the heating means 40B is similar to the above-described recording sheet contact roller 3 in the fundamental structure, and is rotatably supported by the support shaft 40A formed by a metal material, etc. which is excellent in thermal conductivity and is sufficient in mechanical strength so that the entirety thereof is tubular. Within the support shaft 40A, heating means 40B comprised of, e.g., halogen heater, etc. is disposed. This heating means 40B has a length dimension substantially equal to the length dimension of the recording sheet supply roller 40, and uniformly heats the recording sheet supply roller 40 through the support shaft 40A from the internal side thereof so that its temperature is above the melting point of the dispersion medium of the solidified developer 18. Accordingly, the recording sheet supply roller 40 uniformly heats the recording sheet 20 traveled in the state supported by the outer circumferential portion over the entire area in a width direction.

Figure 7:
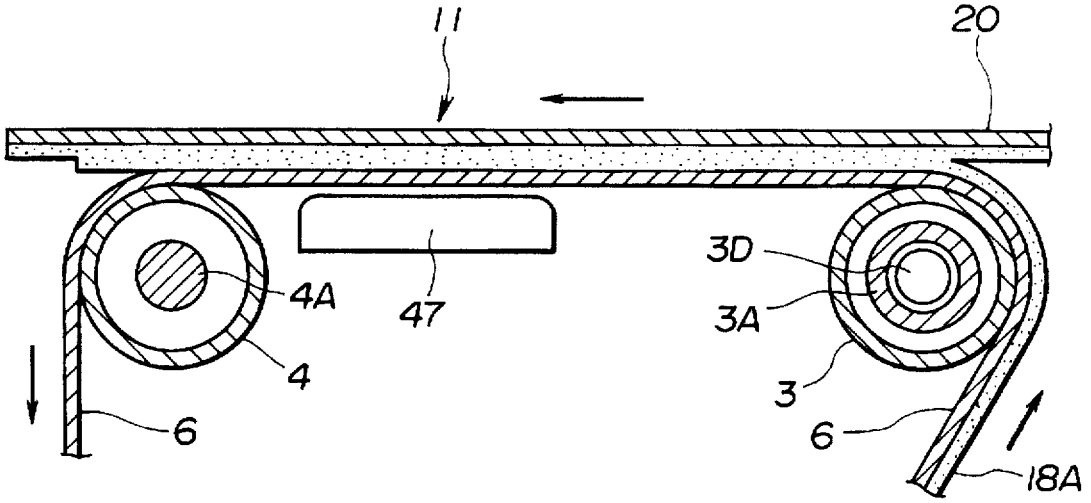
FIG. 7 is an essential part longitudinal cross sectional view for explaining the state where transfer of developer image is carried out with the recording sheet being laid upon endless belt-shaped photosensitive member traveled in a horizontal direction.

The endless belt-shaped photosensitive member 6 is traveled in the state where the recording sheet 20 is caused to be tightly in contact with the surface thereof as shown in FIG. 7 along the horizontal traveling path constituted between the recording sheet contact roller 3 and the recording sheet peeling roller 4. With respect to the solidified developer 18 attached on the surface of the endless belt-shaped photosensitive member 6, since heating means 3D, 40B are respectively provided at the recording sheet contact roller 3 and the recording sheet supply roller 40 as described above in the state where the recording sheet 20 is caused to be in contact with the endless belt-shaped photosensitive member 6, a molten state is securely held.

Figure 9:
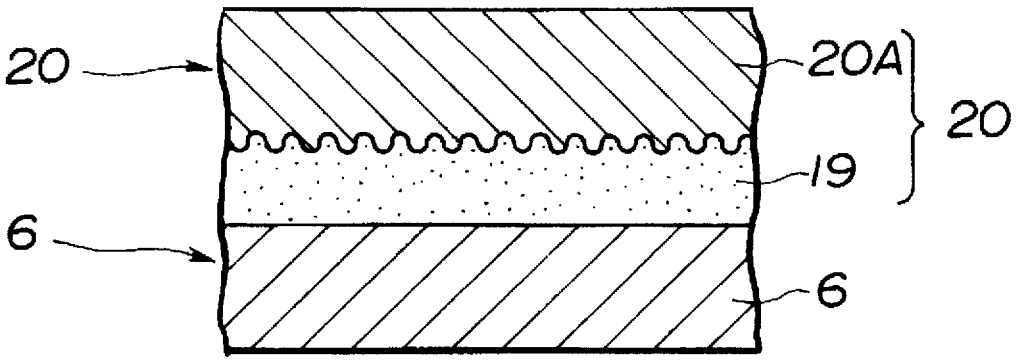
FIG. 9 is an essential part longitudinal cross sectional view for explaining the state where endless belt-shaped photosensitive member in which developer image is formed on the surface thereof and recording sheet are closely in contact with each other so that compatible layer is formed.
Figure 10:
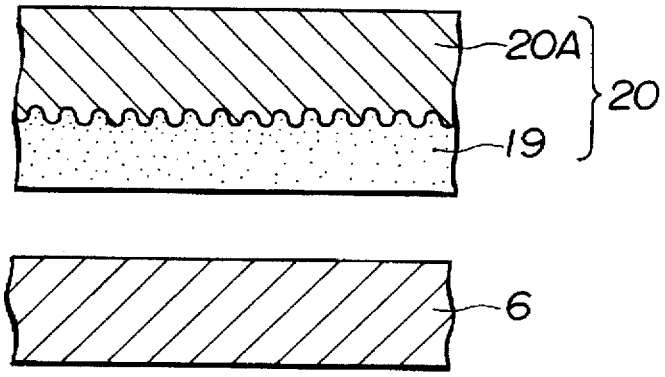
FIG. 10 is an essential part longitudinal cross sectional view for explaining the state where developer image is transferred to recording sheet side, and endless belt-shaped photosensitive member and recording sheet are peeled away.

The endless belt-shaped photosensitive member 6 and the recording sheet 20 are, in the state before they are closely in contact with each other, placed in the state where the solidified developer 18 in the molten state and the resin layer 20B are not compatible as shown in FIG. 8. The endless belt-shaped photosensitive member 6 and the recording sheet 20 are in tight contact with each other in the state where the endless belt-shaped photosensitive member 6 is traveled in a horizontal direction as described above, whereby the solidified developer 18. forming the developer image 18A and the resin layer 20B are caused to be compatible with each other as shown in FIG. 9. Thus, a compatible layer 19 is formed. After the solidified developer 18 is re-solidified by cooling section 11 which will be described later, the recording sheet 20 is peeled off from the endless belt-shaped photosensitive member 6 by the recording sheet peeling roller 4, whereby the compatible layer 19 is placed in the state where it is attached (accompanied) to the recording sheet 20 side as shown in FIG. 10. Thus, developer image 18A is transferred onto the recording sheet 20.

As stated above, in the image forming apparatus 1, since transfer onto the recording sheet 20 of the developer image 18A formed on the surface is carried out at the horizontal traveling path portion where the endless belt-shaped photosensitive member 6 is traveled in a stable state, equally to the case of the image forming apparatus provided with the drum type photosensitive member, there is no possibility that any distortion, etc. of image might take place. Thus, an extremely satisfactory transfer image can be obtained.

At the horizontal traveling path of the endless belt-shaped photosensitive member 6, there is disposed a cooling section 11 for cooling the endless belt-shaped photosensitive member 6 and the recording sheet 20 to which the developer image 18A has been transferred so that their temperatures are less than the melting point of the dispersion medium of the solidified developer 18 to re-solidify the solidified developer 18. This cooling section 11 is composed of, e.g., a radiating pipe mechanism 46 and a cooling plate 47 cooled by the radiating pipe mechanism 46. The cooling plate 47 constitutes the same plane as the recording sheet contact roller 3 and the recording sheet peeling roller 4 to support the back side of the endless belt-shaped photosensitive member 6 over the entire area in width direction to travel the endless belt-shaped photosensitive member 6. It is a matter of course that the cooling plate 47 has a length dimension sufficient to cool the endless belt-shaped photosensitive member 6 and the recording sheet 20 so that the solidified developer 18 is securely brought into a re-solidified state from the molten state in the process of traveling and supporting the endless belt-shaped photosensitive member 6.

The solidified developer 18 is re-solidified as the result of the fact that temperatures of the endless belt-shaped photosensitive member 6 and the recording sheet 20 are gradually lowered down to less than the melting point of the dispersion medium by the cooling plate 47 constituting the cooling section 11 as described above. Thus, the compatible layer 19 of the developer picture 18A formed on the surface of the endless belt-shaped photosensitive member 6 is transferred to the recording sheet 20 side. Of course, the solidified developer 18 portions attached on other portions of the endless belt-shaped photosensitive member 8 are re-solidified as they are on the surface of the endless belt-shaped photosensitive member 6 by an electrostatic coupling force.

In the image forming apparatus 1, since there is employed a configuration such that the solidified developer 18 in molten state is securely re-solidified by the cooling section 11 by the time when the recording sheet 20 reaches the recording sheet peeling roller 4, the compatible layer 19 is securely transferred to the recording sheet 20 side, and transfer of the developer image 18A is carried out with extremely high accuracy in the state where phenomenon of missing of transfer does not take place. Moreover, when the recording sheet 20 reaches the recording sheet peeling roller 4 along with the endless belt-shaped photosensitive member 6, the recording sheet 20 is naturally peeled off by its own rigidity from the endless belt-shaped photosensitive member 6 bent in a vertical direction. With respect to the developer image 18A which has been transferred to the recording sheet 20, since natural peeling between the endless belt-shaped photosensitive member 6 and the recording sheet 20 is carried out in the state where the solidified developer 18 is securely re-solidified, improvement in smoothness of the surface is realized. Accordingly, the structure of the image forming apparatus 1 is simplified as the result of the fact that means for carrying out the peeling between the endless belt-shaped photosensitive member 6 and the recording sheet 20 becomes unnecessary, and a glossy satisfactory transfer image can be obtained.

The endless belt-shaped photosensitive member 6 which has traveled through the cooling section 11 is turned back in a vertical direction by the recording sheet peeling roller 4, and is traveled toward the drive roller 2 side. On the other hand, the recording sheet 20 is traveled in a horizontal direction as it is in the state guided by a blade guide 48, whereby the superposition state with the endless belt-shaped photosensitive member 6 is released by the recording sheet peeling roller 4. Accordingly, the developer image 18A formed on the endless belt-shaped photosensitive member 6 is transferred onto the recording sheet 20 as compatible layer 19 in which the solidified developer 18 and resin layer 20B are compatibly mixed. The recording sheet 20 is traveled toward the recording sheet ejecting section 14 in the state supported by a guide plate 48 disposed in proximity of the recording sheet peeling roller 4.

The recording sheet ejecting section 14 is composed of members such as a guide member 49 bent so that it is, e.g., in circular arc form, a pair of feed rollers 50 (50A, 50B), a fixing roller 51, and a recording sheet receiving table 52, etc. The recording sheet 20 is guided in a U-shape toward an upper side by a guide member 49 for supporting the base 20A side, and is ejected toward the recording sheet receiving table 52 side by the feed rollers 50. Before the recording sheet 20 is ejected to the recording sheet receiving table 52, the compatible layer 19 constituting the developer image 18A is printed by the fixing roller 51.

The endless belt-shaped photosensitive member 6 is turned back toward the drive roller 2 side at the recording sheet peeling roller 4 as described above, whereby the recording sheet 20 is peeled off therefrom, and is then traveled toward the cleaning mechanism section 8 through the position detecting section 7. Then, the endless belt-shaped photosensitive member 6 is caused to undergo, at the cleaning mechanism section 8, static charge elimination processing of the surface by the static charge eliminator 21 as described above, and is further caused to undergo cleaning processing such that solidified developer 18 is scraped away by the blade mechanism 22. The endless belt-shaped photosensitive member 6 thus processed is traveled to the image preparation process section 9 for a second time, where operation of formation of the next image is carried out.

The recording sheet contact section 10 and the recording sheet supply section 13 are not limited to those of the above-described embodiment image forming apparatus, but are diversely developed as in the case of, e.g., respective embodiment image forming apparatuses shown in FIGS. 11 to 19. The respective embodiment image forming apparatuses shown in FIGS. 11 to 20 include the configuration for heating the recording sheet 20 so that its temperature is above the melting point of the dispersion medium of the solidified developer 18. Moreover, the respective embodiment image forming apparatuses shown in FIGS. 16 to 19 include the configuration for traveling the recording sheet 20 in such a manner that it is laid upon the recording sheet contact roller 3 in a satisfactory state. In addition, the respective embodiment image forming apparatuses shown in FIGS. 20 to 22 include a second electrification charger for further improving transfer accuracy of the developer image with respect to the recording sheet.

Figure 11:
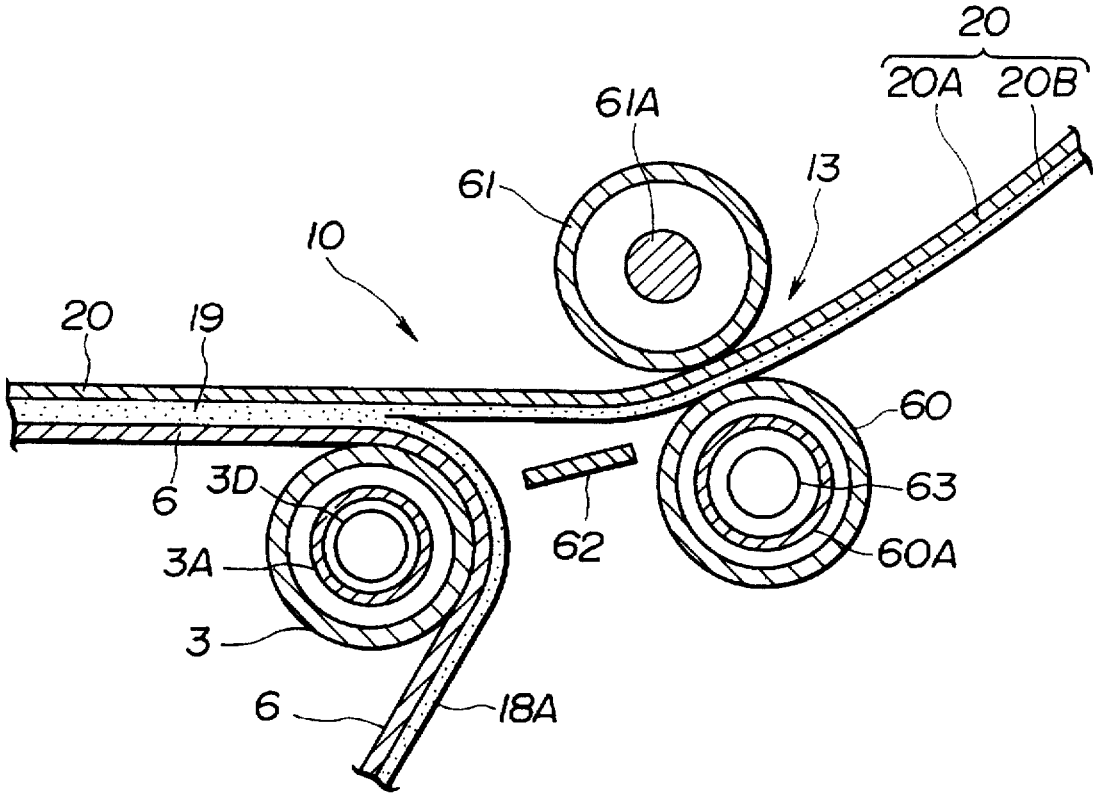
FIG. 11 is an essential part longitudinal cross sectional view showing another embodiment image forming apparatus of a recording sheet contact section provided with recording sheet contact roller including heating means therein and recording sheet supply roller for supporting the lower side of recording sheet, and adapted for traveling recording sheet delivered from recording sheet supply section to recording sheet contact roller in a manner laid upon endless belt-shaped photosensitive member.

In the second embodiment image forming apparatus shown in FIG. 11, the recording sheet 20 is traveled toward the recording sheet contact roller 3 side by a pair of upper and lower recording sheet supply rollers 60, 61, and guide plate 62. The recording sheet supply rollers 60, 61 are formed by materials respectively having elasticity and abrasion resisting property, and are disposed with a spacing substantially equal to the thickness dimension of the recording sheet 20, and are rotationally driven by a drive source (not shown), whereby they carry (convey) the recording sheet 20 in the state put therebetween.

The lower side recording sheet supply roller 60 is formed tubular as a whole having a dimension sufficient to support the entire area in a width direction of the recording sheet 20, and is rotatably supported on a support shaft 80A disposed in the state positioned at the outside of an upper portion with respect to the recording sheet contact roller 3 through bearing (not shown). The support shaft 60A is formed tubular, and the heating means 63 comprised of a halogen heater, etc. is disposed therein. Accordingly, the lower side recording sheet supply roller 60 is heated from the internal by heating means 63, and travels the recording sheet 20 toward the recording sheet contact roller 3 in the state uniformly heated so that its temperature is more than the melting point of the dispersion medium of the solidified developer 18.

The upper side recording sheet supply roller 81 has a length dimension sufficient to support the entire area in a width direction of the recording sheet 20, and is rotatably supported on a support shaft 61A disposed at the position slightly shifted to the recording sheet contact roller 3 side with respect to the support shaft 60A of the lower side recording sheet supply roller 60 through bearing (not shown). Moreover, the guide plate 82 is disposed in the state positioned between the lower side recording sheet supply roller 60 and the recording sheet contact roller 3. The guide plate 62 allows the recording sheet 20 traveled by recording sheet supply rollers 60, 61 in the state put therebetween to come into collision with the outer circumferential portion of the recording sheet contact roller 3.

Accordingly, the recording sheet 20 is traveled on a traveling path in a horizontal direction in the state where it is laid upon the surface of the endless belt-shaped photosensitive member 6 along the outer circumferential portion of the recording sheet contact roller 3. In this case, the recording sheet 20 is placed in the a state slightly bent between the recording sheet supply rollers 60, 61 and the recording sheet contact roller 3 as shown in FIG. 11, whereby it is laid upon the surface of the endless belt-shape photosensitive member 6 with a very small pressure contact force by its own rigidity. Thus, the developer image 18A formed on the surface of the endless belt-shaped photosensitive member 6 is caused to become compatible with the resin layer 20B of the recording sheet 20 to form compatible layer 19 between the surface the endless belt-shaped photosensitive member 6 and the recording sheet 20.

In the second embodiment image forming apparatus thus constituted, the recording sheet supply rollers 60, 61 performs the function of a guide roller for traveling the recording sheet 20 from the recording sheet supply section 13 to the recording sheet contact roller 3, and doubles as heating means for the recording sheet 20. Thus, simplification of the structure is realized, and transfer onto the recording sheet 20 of the developer image 18A formed on the endless belt-shaped photosensitive member 6 can be securely carried out.

Figure 12:
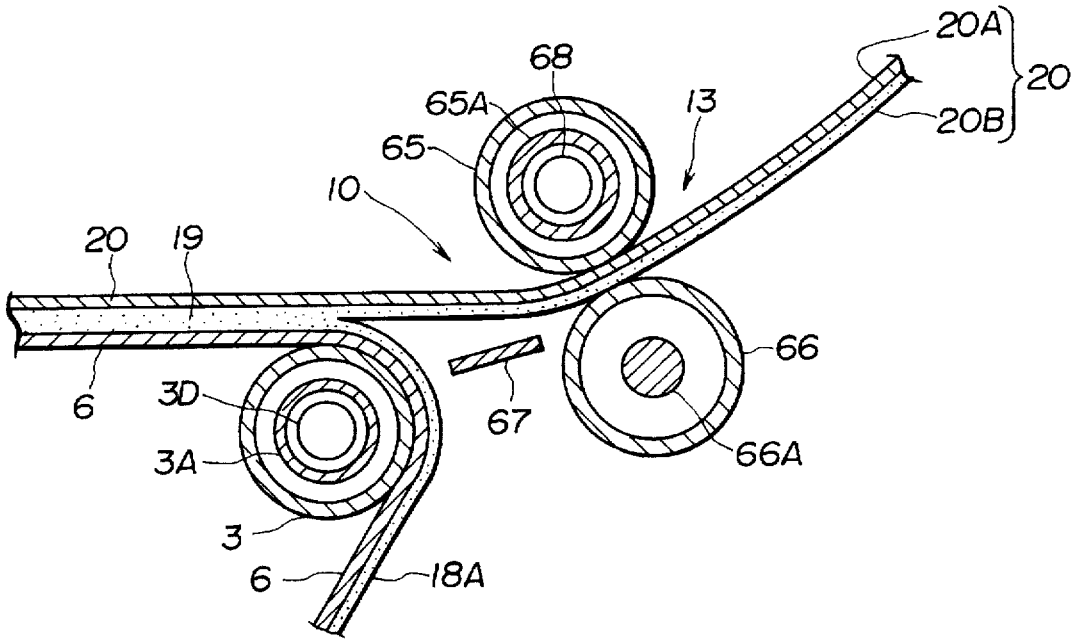
FIG. 12 is an essential part longitudinal cross sectional view showing a further embodiment of image forming apparatus of a recording sheet contact portion provided with recording sheet contact roller including heating means therein and recording sheet supply roller for supporting the upper side of recording sheet, and adapted for traveling recording sheet delivered from recording sheet supply section to recording sheet contact roller in a manner laid upon endless belt-shaped photosensitive member.

While the third embodiment image forming apparatus shown in FIG. 12 is substantially similar to the above-described second embodiment image forming apparatus in the fundamental structure, it is characterized in the configuration in which heating means 68 for heating recording sheet 20 is disposed at the upper side recording sheet supply reel 65 side. The recording sheet 20 is traveled toward the recording sheet contact roller 3 side by a pair of upper and lower recording sheet supply rollers 65, 66 and guide plate 67. The recording sheet supply rollers 65, 66 are respectively formed by materials having elasticity and abrasion resisting property, and are disposed with a spacing substantially equal to the thickness dimension of the recording sheet 20. These rollers are rotationally driven by a drive source (not shown), whereby they carry (convey) the recording sheet 20 in the state where the recording sheet 20 is put therebetween.

The upper side recording sheet supply roller 65 is formed tubular as a whole so as to have a length dimension sufficient to support the entire area in a width direction of the recording sheet 20, and is rotatably supported on a support shaft 65A disposed in the state positioned at the outside of an upper portion with respect to the recording sheet contact roller 3 through bearing (not shown). The support shaft 85A is formed tubular, and the heating means 68 comprised of halogen heater, etc. is disposed therein. Accordingly, the recording sheet supply roller 65 is heated from the internal by heating means 68, and travels the recording sheet 20 toward the recording sheet connection roller 3 in the state where the recording sheet 20 is uniformly heated so that its temperature is more than the melting point of the dispersion medium of the solidified developer 18.

The lower side recording sheet supply roller 66 has a length dimension sufficient to support the entire area in a width direction of the recording sheet 20, and is rotatably supported on a support shaft 66A disposed at the position shifted to the side slightly spaced from the recording sheet contact roller 3 with respect to the support shaft 60A of the upper recording sheet supply roller 60 through bearing (not shown). Moreover, the guide plate 67 is disposed in the state positioned between the lower side recording sheet supply roller 66 and the recording sheet contact roller 3. The guide plate 67 allows the recording sheet 20 traveled in the state put between recording sheet supply rollers 65, 66 to come into collision with the outer circumferential portion of the recording sheet contact roller Accordingly, the recording sheet 20 is traveled on a traveling path in a horizontal direction in the state where it is laid upon the surface of the endless belt-shaped photoconductive body 6 along the outer circumferential portion of the recording sheet contact roller 3. In this case, the recording sheet 20 is placed in the state slightly bent between the recording sheet supply rollers 65, 66 and the recording sheet contact roller 3 as shown in FIG. 12, whereby it is laid upon the surface of the endless belt-shaped photosensitive member 6 with a very small pressure contact force by its own rigidity. Thus, the developer image 18A formed on the surface of the endless belt-shaped photosensitive member 6 is caused to become compatible with the resin layer 20B of the recording sheet 20 to form a compatible layer 19 on the recording sheet In the third embodiment image forming apparatus thus constituted, the recording sheet supply rollers 65, 66 performs the function of guide roller for carrying (conveying) the recording sheet 20 from the recording sheet supply section 13 to the recording sheet contact roller 3, and doubles as heating means for heating the recording sheet 20 so that its temperature is more than the melting point of the dispersion medium of the solidified developer 18. Thus, simplification of the structure is realized, and transfer onto the recording sheet 20 of the developer image 18A formed on the endless belt-shaped photosensitive member 6 can be securely carried out. In addition, in the third embodiment image forming apparatus, since the heating means for the recording sheet 20 is disposed at the upper side recording sheet supply roller 85, maintenance work such as exchange, etc. is facilitated.

Figure 13:
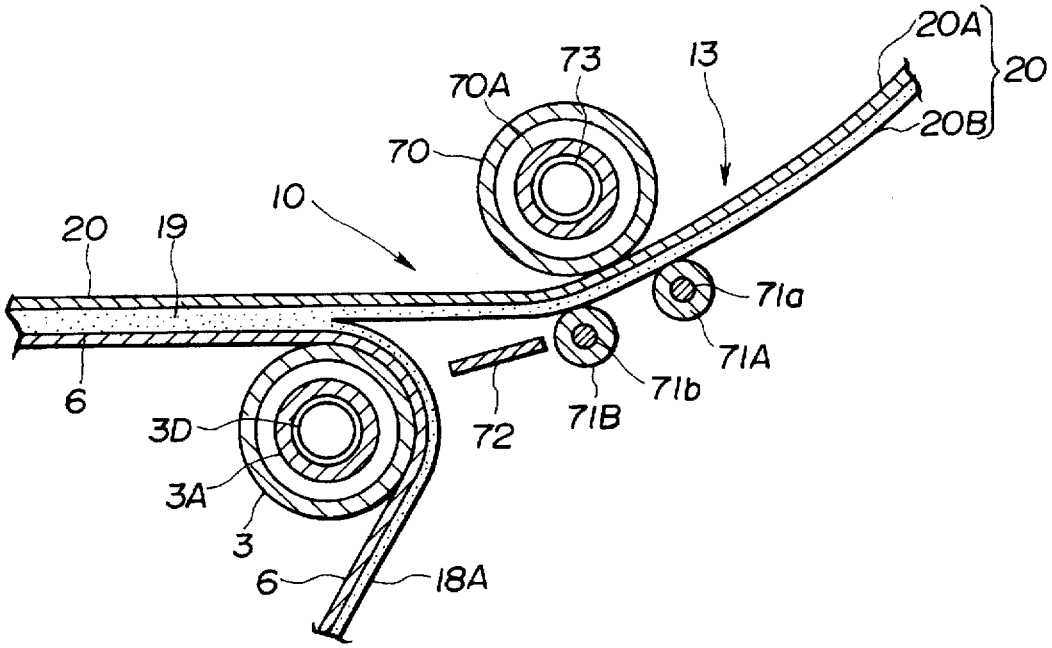
FIG. 13 is an essential part longitudinal cross sectional view showing a further embodiment image forming apparatus of a recording sheet contact portion provided with recording sheet contact roller including heating means therein, recording sheet supply roller for supporting the upper side of recording sheet, and a pair of guide rollers for supporting the lower side of recording sheet, and adapted for traveling recording sheet delivered from recording sheet supply section to recording sheet contact roller in a manner laid upon endless belt-shaped photosensitive member.

While the fourth embodiment image forming apparatus shown in FIG. 13 is substantially similar to the above-described third embodiment image forming apparatus in the fundamental structure in which heating means 73 is disposed within the upper side recording sheet supply roller 70, it is characterized in the configuration in which the lower side portion of the recording sheet 20 is supported by a pair of guide rollers 71A, 71B. The recording sheet 20 is traveled, toward the recording sheet contact roller 3 side by recording sheet supply roller 70, a pair of guide rollers 71A, 71B and guide plate 72.

The recording sheet supply roller 70 is formed tubular as a whole by materials such as rubber, etc. having elasticity and an abrasion resisting property so as to have a length dimension sufficient to support the entire area in a width direction of the recording sheet 20. The recording sheet supply roller 70 is rotatably supported on a support shaft 70A disposed in the state positioned at the outside of an upper portion with respect to the recording sheet contact roller 3 through bearing (not shown). The support shaft 70A is formed tubular, and the heating means 73 comprised of a halogen heater, etc. is disposed therein. Accordingly, the recording sheet supply roller 70 is heated from the internal by heating means 73, and travels the recording sheet 20 toward the recording sheet contact roller 3 in the state where the recording sheet 20 is uniformly heated so that its temperature is more than the melting point of the dispersion medium of the solidified developer 18.

The guide rollers 71A, 71B have a diameter smaller than that of the recording sheet supply roller 70, and have a length dimension sufficient to support the entire area in a width direction of the recording sheet 20. These guide rollers 71A, 71B are respectively rotatably supported on support shafts 71*a*, 71*b* disposed spaced with respect to the traveling direction of the recording sheet 20 with a spacing substantially equal to the thickness of dimension of the recording sheet 20 at a lower part of the recording sheet supply roller 70. Moreover, the guide plate 72 is disposed in the state positioned between one guide roller 71B and the recording sheet contact roller 3. The guide late 672 allows the recording sheet 20 traveled in the state put between recording sheet supply roller 70 and guide rollers 71A, 71B to come into collision with the outer circumferential portion of the recording sheet contact roller 3.

Accordingly, the recording sheet 20 is traveled on a traveling path in a horizontal direction in the state laid upon the surface of the endless belt-shaped photoconductive body 6 along the outer circumferential portion of the recording sheet contact roller 3. In this case, the recording sheet 20 is placed in the state curved along the outer circumferential portion of the recording sheet supply roller 70 by guide rollers 71A, 71B and is placed in the state slightly bent between one guide roller 71B and the recording sheet contact roller 3 as shown in FIG. 13, whereby it is laid upon the surface of the endless belt-shape photosensitive member 6 with a very small pressure contact force by its own rigidity. Thus, the developer image 18A formed on the surface of the endless belt shaped photosensitive member 6 is caused to become compatible with the resin layer 20B of the recording sheet 20 to form compatible layer 19 on the recording sheet 20.

In the fourth embodiment image forming apparatus thus constituted, the recording sheet supply roller 70 doubles as a guide roller for carrying (conveying) recording sheet 20 from recording sheet supply section 13 to recording sheet connection roller 3, and doubles as heating means for heating the recording sheet 20 so that its temperature is more than the melting point of the dispersion medium of the solidified developer 18. Thus, simplification of the structure is realized, and transfer onto the recording sheet 20 of the developer image 18A formed on the endless belt-shaped photosensitive member 6 can be securely carried out. Further, in the fourth embodiment image forming apparatus, since the heating means for recording sheet 20 is disposed at the recording sheet supply roller 70 disposed at an upper part, maintenance work such as exchange, etc. is facilitated. In addition, the fourth embodiment image forming apparatus is of a structure in which the lower side of the recording sheet 20 is supported by guide rollers 71A, 71B of small diameter. Thus, efficiency of space is improved.

Figure 14:
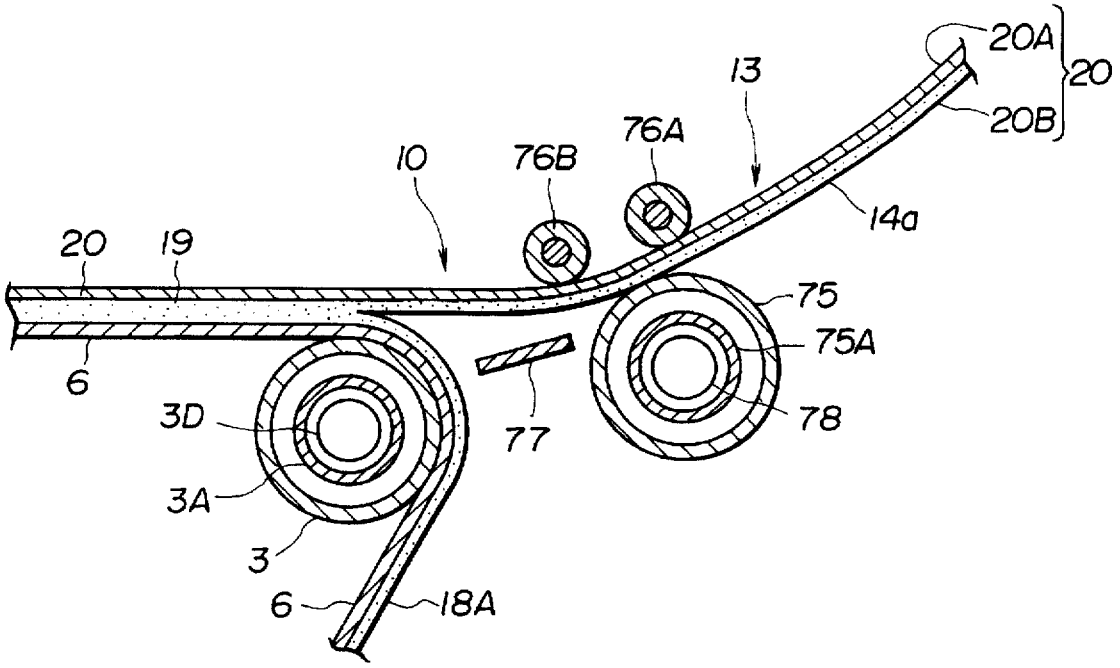
FIG. 14 is an essential part longitudinal cross sectional view showing a further embodiment image forming apparatus of recording sheet contact section provided with recording sheet contact roller including heating means therein, recording sheet supply roller for supporting the lower side of recording sheet, and a pair of guide rollers for supporting the upper side of recording sheet, and adapted for traveling recording sheet delivered from recording sheet supply section to recording sheet contact roller in a manner laid upon endless belt-shaped photosensitive member.

While the fifth embodiment image forming apparatus shown in FIG. 14 is substantially similar to the fundamental structure including the recording sheet supply roller 75 of large diameter within which the heating means 73 is disposed and a pair of guide rollers 76A, 76B of small diameter similar to the above-described fourth embodiment image forming apparatus, it is characterized in the configuration in which the recording sheet supply roller 75 is disposed at the lower side, and the guide rollers 78A, 76B are disposed at the upper side. The recording sheet 20 is traveled toward the recording sheet contact roller 3 side by the recording sheet supply roller 75, a pair of guide rollers 76A, 76B and guide plate 77.

The recording sheet supply roller 75 is formed tubular by material such as rubber, etc. having elasticity and abrasion resisting property so as to have a length dimension sufficient to support the entire area in a width direction of the recording sheet 20 as a whole. The recording sheet supply roller 75 is rotatably supported on a support shaft 70A disposed in the state positioned at the outside of an upper part with respect to the recording sheet contact roller 3 through bearing (not shown), and travels the recording sheet 20 with the lower side thereof being supported. The support shaft 75A is formed tubular, and heating means 78 comprised of halogen heater, etc. is disposed therein. Accordingly, the recording sheet supply roller 75 is heated from the internal by the heating means 78, and travels the supported recording sheet 20 toward the recording sheet contact roller 3 in the state where the recording sheet 20 is uniformly heated so that its temperature is more than the melting point of the dispersion medium of the solidified developer 18.

The guide rollers 78A, 78B are caused to have a diameter smaller than that of the recording sheet supply roller 75, and respectively have length dimensions sufficient to support the entire area in a width direction of the recording sheet 20. These guide rollers 76A, 76B are respectively rotatably supported on support shafts 76*a*, 76B disposed in a manner spaced with respect to traveling direction with a spacing substantially equal to the thickness dimension of the recording sheet 20 at an upper part of the recording sheet supply roller 70. Moreover, the guide plate 77 is disposed in the state positioned between the recording sheet supply roller 75 and the recording sheet contact roller 3. The guide plate 77 allows the recording sheet 20 traveled in the state put between the recording sheet supply roller 75 and the guide rollers 76A, 76B to come into collision with the outer circumferential portion of the recording sheet contact roller 3.

Accordingly, the recording sheet 20 is traveled on the traveling path in a horizontal direction in the state laid upon the surface of the endless belt-shaped photosensitive member 6 along the outer circumferential portion of the recording sheet contact roller 3. In this case, the recording sheet 20 is caused to come into pressure contact with the outer circumferential portion of the supply roller 75 in the state where the upper side thereof is held by one guide roller 76A as shown in FIG. 14, whereby the recording sheet 20 is placed in the state where it is caused to undergo displacement slightly in an upper direction. Further, the recording sheet 20 is held by the other guide roller 76B, whereby it is caused to undergo displacement slightly in a lower direction. Accordingly, the recording sheet 20 is laid upon the surface of the endless belt-shaped photosensitive member 6 with a very small pressure contact force by its own rigidity. Thus, developer image 18A formed on the surface of the endless belt-shaped photosensitive member 6 is, in the middle where it is traveled through the horizontal traveling path, caused to become compatible with a resin layer 20B of the recording sheet 20 to form a compatible layer 19 on the recording sheet 20.

In the fifth embodiment image forming apparatus thus constituted, the recording sheet supply roller 75 doubles as a guide roller for carrying (conveying) recording sheet 20 from recording sheet supply section 13 to recording sheet contact roller 3, and doubles as heating means for heating the recording sheet 20 so that its temperature is more than the melting point of the dispersion medium of the solidified developer 18. Thus, simplification of the structure is realized, and transfer onto the recording sheet 20 of the developer image 18A formed on the endless belt-shaped photosensitive member 6 can be securely carried out. In addition, the fifth embodiment image forming apparatus is of a structure in which the recording sheet 20 is supported by guide rollers 71A, 71B of small diameter. Thus, efficiency of space is improved.

Figure 15:
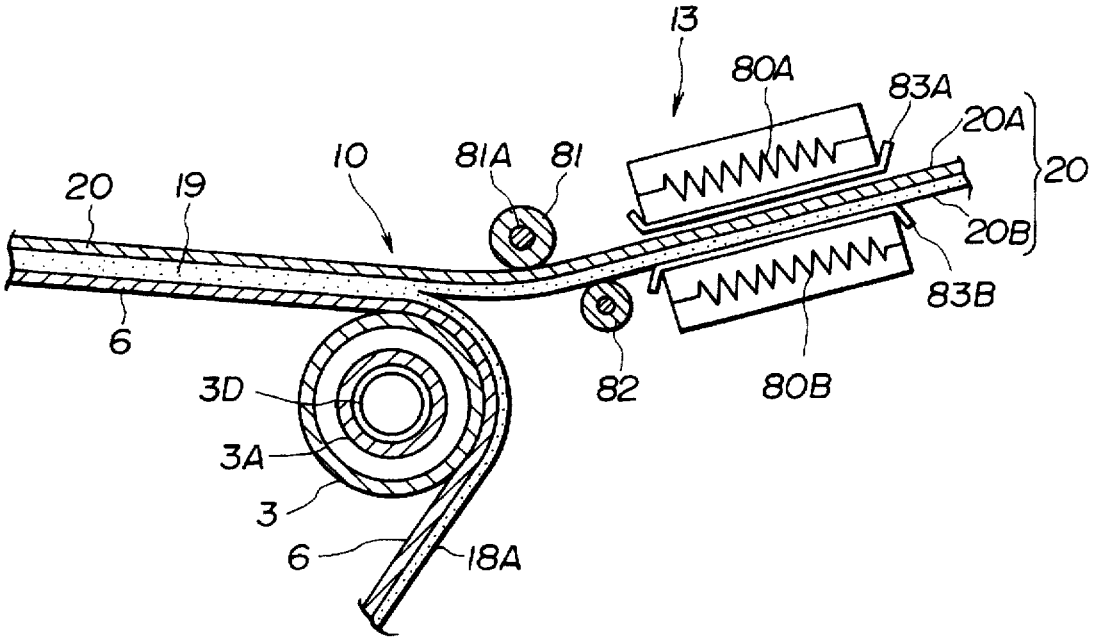
FIG. 15 is an essential part longitudinal cross sectional view showing a further embodiment image forming apparatus of a recording sheet contact portion provided with recording sheet contact roller including heating means therein and preliminary heating means for recording sheet, and adapted for traveling recording sheet delivered from recording sheet supply section to recording sheet contact roller in a manner laid upon endless belt-shaped photosensitive member.

The sixth embodiment image forming apparatus shown in FIG. 15 is characterized in the configuration in which, in order to efficiently heat the recording sheet 20, a pair of heating means 80A, 80B for preliminarily heating the recording sheet 20 are provided at the recording sheet supply section 13 with the traveling path of the recording sheet 20 being put therebetween. The recording sheet 20 is traveled and driven by a guide roller mechanism (not shown), and is passed through the portion between the heating means 80A, 80B. Then, the recording sheet 20 is traveled toward the recording sheet contact roller 3 side through the recording sheet supply roller 81 and the guide roller 82.

The heating means 80A, 80B have a spacing therebetween slightly greater than the thickness dimension of the recording sheet 20. These heating means 80A, 80B are opposed in parallel to each other, whereby they are respectively integrally connected at the back sides of a pair of upper and lower guide plates 83A, 83B constituting the traveling path of the recording sheet 20. These guide plates 83A, 83B are formed by material having high thermal conductivity and abrasion resisting property, e.g., aluminum, etc. The heating means 80A, 80B heat these guide plates 83A, 83B so that their temperature is more than the melting point of the dispersion medium of solidified developer 18.

The recording sheet supply roller 81 is formed by a material such as rubber, etc. having elasticity and an abrasion resisting property so as to have a length dimension sufficient to support the entire area in a width direction of the recording sheet 20 as a whole. This recording sheet supply roller 81 is rotatably supported on a support shaft 81A disposed in the state positioned at the outside of an upper part with respect to the recording sheet contact roller 3, and supports the upper side of the recording sheet 20 to travel the recording sheet 20. More particularly, the recording sheet supply roller 81 is disposed at an upper part of the recording sheet contact roller 3 with a spacing substantially equal to the thickness dimension of the recording sheet 20 and the endless belt-shaped photosensitive member 6 with respect to the outer circumferential portion of the recording sheet contact roller 3. It is to be noted that since the above-mentioned recording sheet supply roller 81 is not required to provide heating means therein as in the case of the above-described respective embodiment image forming apparatuses, this roller 81 is constituted as a roller of slightly smaller diameter.

The guide roller 82 has a length dimension sufficient to support the entire area in a width direction of the recording sheet 20, and is disposed in the state positioned at the guide plate 83B side with respect to the recording sheet supply roller 82 to support the lower side of the recording sheet 20 to travel it. This guide roller 62 is caused to have a diameter further smaller than that of the recording sheet supply roller 81.

The recording sheet 20 is traveled toward the guide roller 82 within the traveling path constituted between guide plates 83A, 83B heated by heating means 80A, 80B so that its temperature is more than the melting point of the dispersion medium of the solidified developer 18, whereby that recording sheet 20 is uniformly heated. The recording sheet 20 comes into collision with the outer circumferential portion of the recording sheet supply roller 81 in the state where it is caused to undergo displacement slightly in an upper direction by the guide roller 82. Then, the recording sheet 20 is laid upon the surface of the endless belt-shaped photosensitive member 6 supported by the recording sheet contact roller 3 in the state where it is caused to undergo displacement slightly to the lower side in the recording sheet supply roller 81, and is traveled.

Accordingly, since the recording sheet 20 is laid upon the surface of the endless belt-shaped photosensitive member 6 in the state where the upper side thereof is held by the recording sheet supply roller 81 as shown in FIG. 15, a very small pressure contact force is applied by its own rigidity. Since the recording sheet 20 is laid upon the surface of the endless belt-shaped photosensitive member 6 with a very small pressure in the state preliminarily heated by heating means 80A, 80B, and is traveled through the horizontal traveling path, the developer image 18A formed on the surface of the endless belt-shaped photosensitive member 6 and the resin layer 20B are caused to become compatible in a satisfactory state to form a compatible layer 19.

In the sixth embodiment image forming apparatus constituted as described above, there is employed a configuration in which heating means 80A, 80B for preliminarily heating the recording sheet 20 are provided at the recording sheet supply section 13 to allow the recording sheet 20 to be laid upon the endless belt-shaped photosensitive member 6 in the state where the recording sheet is heated by these heating means 80A, 80B so that its temperature is more than the melting point of the dispersion medium of the solidified developer 18, thereby making it possible to securely carry out transfer onto the recording sheet 20 of the developer image 18A formed on the endless belt-shaped photosensitive member 6. In addition, these heating means 80A, 80B can relatively easily carry out temperature management, and to heat the recording sheet 20 in an optimum state thus to transfer the developer image 18A onto the recording sheet 20 in a satisfactory state.

Figure 16:
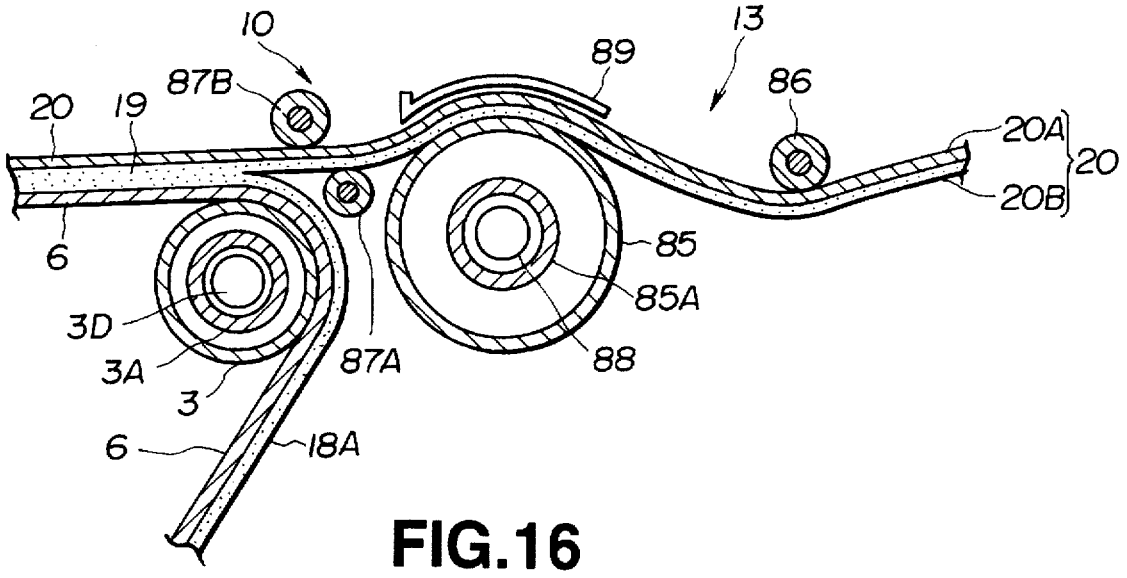
FIG. 16 is an essential part longitudinal cross sectional view showing a further embodiment image forming apparatus of a recording sheet connection section provided with recording sheet contact roller including heating means therein, and preliminary heating roller for heating recording sheet, and adapted for traveling recording sheet delivered from recording sheet supply section to recording sheet contact roller in a manner laid upon endless belt-shaped photosensitive member.

The seventh embodiment image forming apparatus shown in FIG. 16 is characterized in the configuration in which a preliminarily heating roller 85 for preliminarily heating the recording sheet 20 is provided at the recording sheet supply section 13 in order to efficiently heat the recording sheet 20. The recording sheet 20 is caused to undergo travel-driving by a guide roller mechanism (not shown), and is traveled toward the preliminary heating roller 85 through an auxiliary pressure contact roller 86 disposed movably in upper and lower directions in the state positioned at the upper side of the recording sheet 20. The preliminary heating roller 85 supports the lower side of the recording sheet 20 to travel the recording sheet 20 toward a pair of upper and lower recording sheet supply rollers 87A, 87B.

The preliminary heating roller 85 has a length dimension sufficient to support the recording sheet 20 over the entire area in a width direction, is disposed in the state positioned slightly at the outside of an upper part with respect to the recording sheet contact rollers, and is formed tubular by material such as aluminum, etc. having high conductivity. This preliminary heating roller 85 is rotatably supported on a support shaft 85A formed tubular through bearing (not shown). Within the support shaft 85A, a heating means 88 comprised of a halogen heater, etc. is included (built-in). The heating means 88 heats the preliminary heating roller 85 from the internal thereof so that its temperature is more than the melting point of the dispersion medium of the solidified developer 18. In this example, at an upper part of the preliminary heating roller 85, a guide plate 89 circular arc shaped in cross section is disposed so as to cover the outer circumferential portion. This guide plate 89 prevents the recording sheet 20 from floating up, and prevents a worker (operator) from erroneously coming into contact with the high temperature preliminary heating roller 85 during maintenance, etc.

The recording sheet supply rollers 87A, 87B are guide rollers of diameter smaller than that of the recording sheet contact roller 3 or the preliminary heating roller 85, wherein the upper side recording sheet supply roller 87B is disposed in the state positioned at the recording sheet contact roller 3 with respect to the lower side recording sheet supply roller 87A, and with a spacing substantially equal to the thickness dimension of the recording sheet 20. Moreover, these recording sheet supply rollers 87A, 87B are disposed in the state positioned slightly at the outside of an upper part with respect to the recording sheet contact roller 3. The recording sheet supply rollers 87A, 87B are formed by a material such as rubber, etc. having elasticity and an abrasion resisting property so as to have a length dimension sufficient to support the entire area in a width direction of the recording sheet 20 as a whole.

The recording sheet 20 is pushed (thrust) downwards by the auxiliary pressure contact roller 86, whereby it is traveled toward the outer circumferential portion of the preliminary heating roller 85 in the state where it is caused to undergo displacement in an upper direction. Thus, the recording sheet 20 is uniformly heated by the preliminary heating roller 85 so that its temperature is more than the melting point of the dispersion medium of the solidified developer 18. The recording sheet 20 is caused to come into collision with the outer circumferential portion of the lower side recording sheet supply roller 87A from the preliminary heating roller 85, and is caused to come into collision with the outer circumferential portion of the upper side recording sheet supply roller 87B in the state where it is subjected to displacement slightly in an upper direction. Then, the recording sheet 20 is subjected to displacement slightly toward the lower side by the upper side recording sheet supply roller 87B, and is traveled in the state laid upon with the surface of the endless belt-shaped photosensitive member 6 supported by the recording sheet contact roller 3.

Accordingly, since the recording sheet 20 is laid upon the surface of the endless belt-shaped photosensitive member 6 in the state where the upper side thereof is held by the upper side recording sheet supply roller 87B as shown in FIG. 16, a very small pressure contact force is applied by its own rigidity. As stated above, since the recording sheet 20 is laid upon the surface of the endless belt-shaped photosensitive member 6 with a very small pressure in the state preliminarily heated by the preliminary heating roller 85, and is traveled along the horizontal traveling path, the developer image 18A formed on the surface of the endless belt-shaped photosensitive member 6 and the resin layer 20B are caused to become compatible in a satisfactory state to form a compatible layer 19.

In the seventh embodiment image forming apparatus thus constituted, there is employed a configuration in which the preliminary heating roller 85 for preliminarily heating the recording sheet 20 is provided at the recording sheet supply section 13 to travel the recording sheet 20 in such a manner that it is laid upon the endless belt-shaped photosensitive member 6 in the state heated by the preliminary heating roller 85 so that its temperature is more than the melting point of the dispersion medium of the solidified developer 18, and to allow the preliminary heating roller 85 to double as a guide roller for allowing the recording sheet 20 to undergo curve-traveling in order to apply a pressure contact force with respect to the endless belt-shaped photosensitive member 6 to the recording sheet 20, thereby making it possible to securely carry out transfer onto the recording sheet 20 of the developer image 18A formed on the endless belt-shaped photosensitive member 6. In addition, temperature management of the preliminary heating roller 85 can be relatively easily carried out, and the recording sheet 20 can be heated so that there results an optimum state. Thus, the developer image 18A is transferred onto the recording sheet 20 in a satisfactory state.

Figure 17:
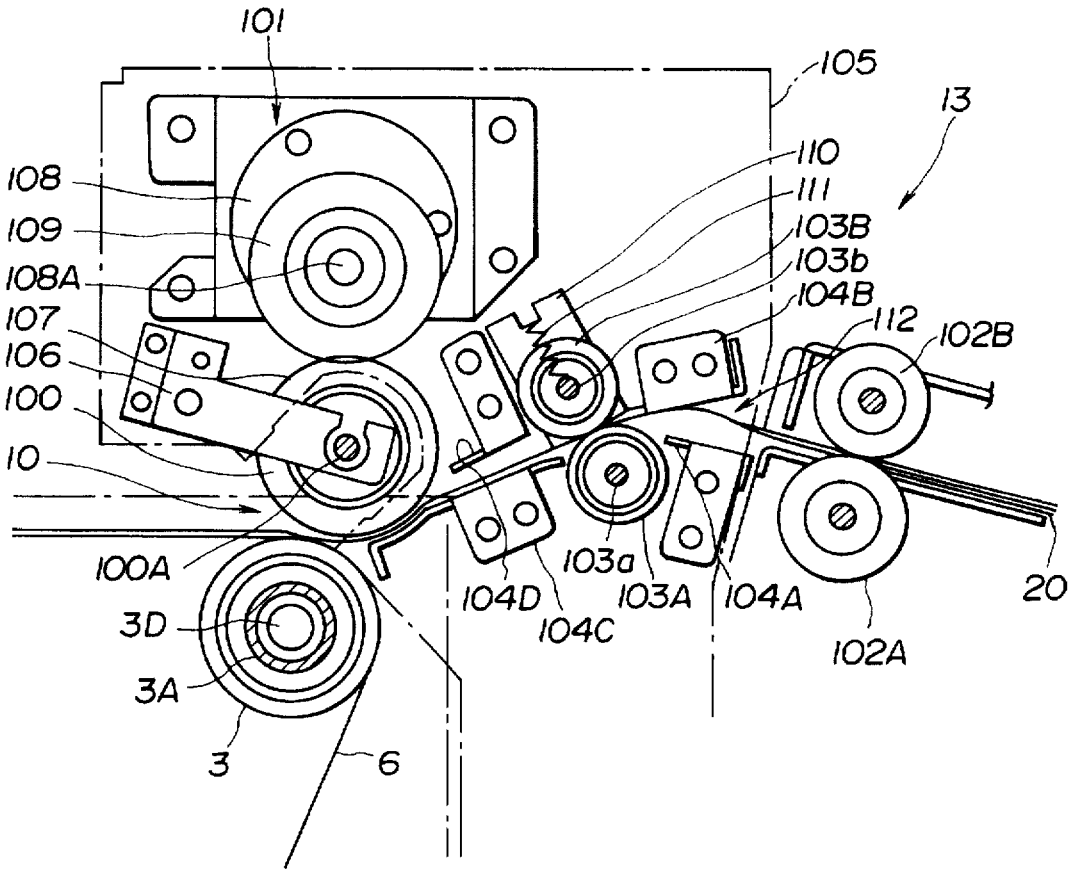
FIG. 17 is an essential part longitudinal cross sectional view showing a further embodiment image forming apparatus in which a bending)flexible) portion permitting a portion of recording sheet to be bent is provided at recording sheet supply section.

The eighth embodiment image forming apparatus shown in FIG. 17 is characterized in that the recording sheet supply section 13 is of a structure to allow the recording sheet 20 to be laid upon the recording sheet contact roller 3 in a satisfactory state. The recording sheet supply section 13 is composed of a recording sheet supply roller 100 disposed in the state positioned slightly at the outside of an upper part with respect to the recording sheet contact roller 3, drive means 101 for rotationally driving the recording sheet supply roller 100, a first guide roller mechanism 102 and a second guide roller mechanism 103 for carrying (conveying) the recording sheet delivered from the recording sheet cassette (not shown), and a guide plate mechanism 104, etc. The first guide roller mechanism 102 and the second guide roller mechanism 103 are disposed with a predetermined spacing with respect to traveling direction of the recording sheet 20.

The recording sheet supply roller 100 is formed by a material such as rubber, etc. having elasticity and an abrasion resisting property so as to have a length direction sufficient to support the entire area in a width direction of the recording sheet 20 as a whole. This recording sheet supply roller 100 is adapted so that the spacing between the roller 100 and the recording sheet contact roller 3 is caused to be substantially equal to thickness dimension with respect to the endless belt-shaped photosensitive member 6 and the recording sheet 20, and is supported on a support shaft 100A rotatably supported and mounted at the free end side of a bracket member 106 fixed at one end portion to a sub-frame 105. A follower gear (toothed wheel) 107 is fixed at the support shaft 100A, and is caused to undergo transmission of rotation from the drive means 101.

The drive means 101 is composed of a drive motor 108 attached to the sub frame 105, and a drive gear (toothed wheel) 109 fixed to an output shaft 108A of the drive motor 108. The drive motor 108 is driven by a paper feed start signal from the control section to rotationally drive the drive gear 109 in a counterclockwise direction in FIG. 16. The drive gear 109 is engaged with the follower gear 107, and rotationally drives the recording sheet supply roller 100 through the support shaft 100A in a clockwise direction in the figure.

The first guide roller mechanism 102 is composed of a pair of guide rollers 102A, 102B disposed facing to the traveling path of the recording sheet 20 delivered from the recording sheet cassette and carried (conveyed) in a left ascending state. These guide rollers 102A, 102B are adapted so that the spacing between those opposite members is caused to be substantially equal to thickness dimension of the recording sheet 20, and is faced to the traveling path of the recording sheet 20. In addition, these guide rollers 102A, 102B are disposed in the state where the lower side guide roller 102A is slightly closer to the recording sheet contact roller 3 side with respect to the upper side guide roller 102B.

The second guide roller mechanism 103 is a guide roller for traveling the recording sheet 20 in a left descending state as described later, and is composed of a pair of guide rollers 103A, 103B of which spacing therebetween is caused to be substantially equal to the thickness dimension of the recording sheet 20. These guide rollers 103A, 103B are such that the lower side guide roller 103A is placed in the state slightly closer to the first guide roller mechanism 102 side with respect to the upper side guide roller 103B. The lower side guide roller 103 is rotatably axially affixed on a support shaft 103*a* supported at the sub-frame 105, whereby it is constructed as a so-called a fixed roller of which shaft is fixed.

On the other hand, the upper side guide roller 103B is rotatably axially affixed on a support shaft 103B supported at a bracket 110 attached to the sub-frame 105. This support shaft 103*b* is inserted into a U-shaped axial hole opened at the upper portion thereof, of which the detail is omitted, provided at the bracket 110. The upper side guide roller 103B is biased to the lower side guide roller 103A side by a coil spring 111 in a compressed state disposed between the support shaft 103*b* and the bracket 110. It is a matter of course that the coil spring 111 is a spring having a very small elastic force, and does not constitute an obstacle to the traveling of the recording sheet 20. The upper side guide roller 103B is constructed as a movable roller in which the support shaft 103*b* is moved.

The guide plate mechanism 104 is composed of the above-described first guide roller mechanism 102, the above-described second guide roller mechanism 103, and a plurality of guide plates 104A to 104D respectively disposed in upper and lower directions in the state positioned between the recording sheet connection roller 3 and the recording sheet supply roller 100. These guide plates 104A to 104D are all attached to the sub-frame 105, and constitutes a traveling path of the recording sheet 20 between the upper and lower plates. A first lower side guide plate 104A disposed between the lower side guide roller 102A of the first guide roller mechanism 102 and the lower side guide roller 103B of the second guide roller mechanism 103 is attached to the sub-frame 105 in a left ascending state as a whole, and the front end portion thereof is caused to be closer to the outer circumferential portion of the lower side guide roller 103B. The first upper side guide plate 104B is caused to be in left descending state, and is attached to the sub-frame 105 so as to constitute a spacing 112 in a height direction with respect to the first lower side guide plate 104A. The spacing 112 constitutes a bending portion of the recording sheet as described later.

The second lower side guide plate 104C disposed between the lower side guide roller 103B of the second guide roller mechanism 103 and the recording sheet contact roller 3 is attached to the sub-frame 105 in a left descending state as a whole. The second lower side guide plate 104C is, similarly to the first guide plate member 45A of the above-described first embodiment image forming apparatus, such that the front end portion thereof is bent in a lower direction at the position spaced with respect to the recording sheet supply roller 100, is formed so that it is circular arc shaped in cross section along the outer circumferential portion of the recording sheet supply roller 100, and is extended in a manner closer to the outer circumferential portion of the recording sheet connection roller 3. The second upper side guide plate 104D is opposed to the second lower side guide plate 104C, and the front end portion thereof is attached to the sub-frame 105 in a left descending state in a manner closer to the outer circumferential portion of the recording sheet supply roller 100.

In the image forming apparatus thus constituted, the recording sheet supply roller 100 is rotationally driven by a drive motor 101 in the state where a speed difference is given so as to slightly become fast or slightly become slow with respect to a traveling speed of the endless belt-shaped photosensitive member 6. The recording sheet 20 is traveled in the state curved substantially mountain-shaped within the recording sheet traveling path constituted by the guide plate mechanism 104 by the first guide roller mechanism 102 and the second guide roller mechanism 103, and is caused to come into collision with the outer circumferential portion of the recording sheet contact roller 3 through the recording sheet supply roller 100. Accordingly, the recording sheet 20 is traveled in the state laid upon the surface of the endless belt-shaped photosensitive member 6 with a very small pressure contact force by its own rigidity.

For the image forming apparatus, it is ideal that the endless belt-shaped photosensitive member 6 and the recording sheet 20 are traveled in a manner overlapping each other at the same speed. However, since the image forming apparatus is of a structure such that the endless belt-shaped photosensitive member 6 and the recording sheet 20 are traveled by traveling systems independent of each other, it is extremely difficult to carry out management so as to travel them at the same speed. Further, for example, the traveling speed changes by traveling load, etc. within the traveling path of the recording sheet 20. Such change of the traveling state of the endless belt-shaped photosensitive member 6 and the recording sheet 20 would cause an image abrasion phenomenon, etc. of the developer image 18A transferred onto the recording sheet 20. Moreover, change of the traveling state of the endless belt-shaped photosensitive member 6 and the recording sheet 20 becomes the traveling load of the endless belt-shaped photosensitive member 6, and further becomes the drive load of the recording sheet supply roller 100 for allowing the recording sheet 20 to be laid upon the surface of the endless belt-shaped photosensitive member 6.

Since the image forming apparatus is of a structure in which the recording sheet contact reel 100 is rotationally driven with a speed difference with respect to the endless belt-shaped photosensitive member 6, bending takes place in the recording sheet 20 in the state where the recording sheet 20 is caused to come into collision with the endless belt-shaped photosensitive member 6. However, such bending of the recording sheet 20 is absorbed as the result of the fact that the recording sheet 20 is curved at the bending portion 112 constituted between the first guide roller mechanisms 102 and the second guide roller mechanism 103. Accordingly, the portion preceding from the bending portion 112 of the recording sheet 20 is traveled at the same speed as that of the endless belt-shaped photosensitive member 6 by pressure contact force with respect to the endless belt-shaped photosensitive member 6.

In the case where the recording sheet 20 is drawn out from the recording sheet supply section 13 followed by a traveling operation of the endless belt-shaped photosensitive member 6, it is smoothly drawn out as the result of the fact that the upper side guide roller 103B constituting the second guide roller mechanism 103 is moved upwardly against the elastic force of the coil spring 111. In a manner stated above, the recording sheet 20 is traveled at the same speed with the portion laid upon the endless belt-shaped photosensitive member 6 being integral with the endless belt-shaped photosensitive member 6. Accordingly, in the image forming apparatus, there is no possibility that the above-described problem of image abrasion, etc. due to a difference of traveling speed between the endless belt-shaped photosensitive member 6 and the recording sheet 20 may take place.

Figure 18:
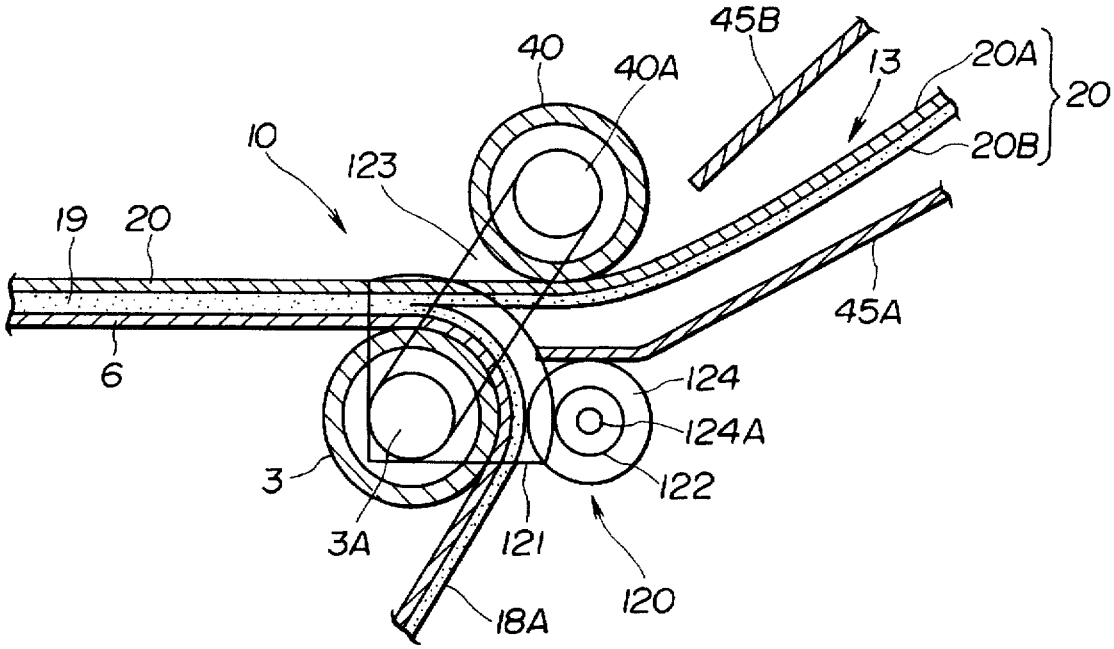
FIG. 18 is an essential part longitudinal cross sectional view showing a further embodiment image forming apparatus in which a pressure contact force adjustment mechanism for recording sheet is provided at recording sheet supply section.
Figure 19:
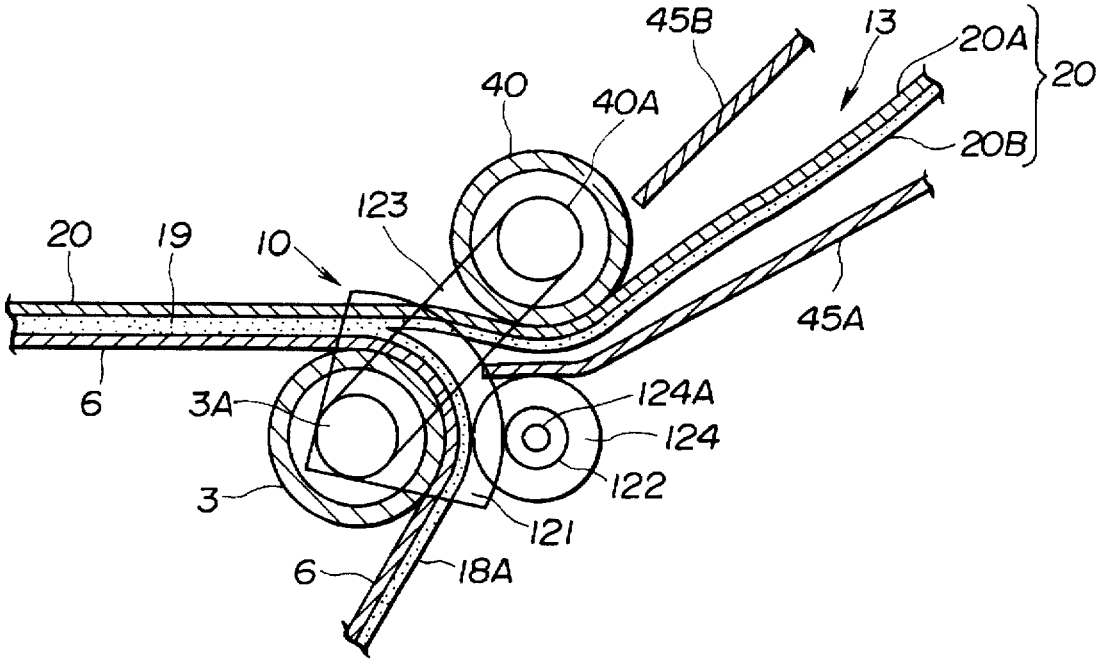
FIG. 19 is an essential part longitudinal cross sectional view for explaining adjustment operation of pressure contact force adjustment mechanism for recording sheet.

While the ninth embodiment image forming apparatus shown in FIGS. 18 and 19 is adapted so that the recording sheet 20 is caused to come into pressure contact with the endless belt-shaped photosensitive member 6 by its own rigidity similar to the above-described respective embodiment image forming apparatuses, it is characterized in the configuration in which there is provided a pressure contact force adjustment mechanism 120 for permitting the pressure contact force of the recording sheet 20 to be adjustable. It is to be noted that while, for the brevity of explanation, recording sheet contact roller 3 and recording sheet supply roller 40 are of a structure in which no heating means is disposed therein, it is a matter of course that, similarly to the above-described respective embodiment image forming apparatuses, support shafts 3A, 40A are formed tubular to provide heating means therein.

The pressure contact adjustment mechanism 120 is composed of members such as a fan-shaped adjustment gear 121 fixed to one end side of the support shaft 3A for rotatably supporting the recording sheet contact roller 3, an adjustment drive gear 122 meshed (engaged) with the adjustment gear 121, a connecting member 123 connecting between the recording sheet contact roller 3 and the recording sheet supply roller 40, and an adjustment motor 124, etc. The adjustment gear 121 is such that its radius dimension is caused to be greater than the radius dimension of the recording sheet contact roller 3, the pivotal portion is fixed to one end side of the support shaft 3A, and a gear is formed at the circular arc shaped outer circumferential portion. This adjustment gear 121 is engaged with the adjustment drive gear 122 disposed at a lower part of the lower side guide plate 45A constituting the traveling path of the recording sheet The adjustment drive gear 122 is fixed to an output shaft 124A of a reversibly rotatably adjustment motor 124, and is rotationally driven in a clockwise direction or in a counterclockwise direction in FIG. 18. A connection member 123 is such that one end side is fixed to one end portion of the support shaft 3A of the recording sheet contact roller 3, and the other end side is fixed to one end portion of the support shaft 40 for rotatably supporting the recording sheet supply roller 40. The support shaft 3A of the recording sheet contact roller 3 is fixed to a movable frame (not shown), and the support shaft 40A of the recording sheet supply roller 40 is supported by the connection member 123. Accordingly, the recording sheet supply roller 40 is rotationally operated about the support shaft 3A of the recording sheet contact roller 3 with the connection member 123 being as radius.

The recording sheet 20 is traveled in a right descending state up to the outer circumferential portion of the recording sheet supply reel 40 through a guide roller mechanism (not shown) within the traveling path constituted between the guide plates 45A, 45B. Then, the recording sheet 20 is subjected to displacement slightly in an upper direction at the outer circumferential portion, and is laid upon the surface of the endless belt-shaped photosensitive member 6 turned back in a horizontal direction in the state supported by the outer circumferential portion of the recording sheet contact roller 3. The recording sheet 20 is placed in the state where it bridges over between the recording sheet supply roller 40 and the recording sheet contact roller 3, whereby it is laid upon the surface of the endless belt-shaped photosensitive member 6 with a very small pressure contact force by its own rigidity.

Since strength of the own rigidity of its recording sheet 20 is varied by material and/or thickness dimension, etc. of base 20A, in the case where recording sheet of the specification different in these properties is used, pressure contact force with respect to the endless belt-shaped photosensitive member 6 would be changed. Such unevenness of pressure contact force between the endless belt-shaped photosensitive member 6 and the recording sheet 20 gives rise to a problem such that the developer image 18A formed on the surface of the endless belt-shaped photosensitive member 6 fails to be transferred onto the recording sheet 20 in a fixed state. In addition, unevenness of pressure contact force between the endless belt-shaped photosensitive member 6 and the recording sheet 20 prevents that, e.g., the endless belt-shaped photosensitive member 6 and the recording sheet 20 are traveled in one body in an overlapping manner, giving rise to shift or distortion of the transfer image.

The image forming apparatus is provided with, e.g., a sheet selection sensor for selecting the recording sheet 20 to be loaded into the recording sheet cassette although illustrated to drive the pressure contact force adjustment mechanism 120 by an output of the sheet selection sensor to make an adjustment such that a pressure contact force with respect to the endless belt-shaped photosensitive member 6 is fixed with respect to a recording sheet 20 different in material and/or thickness dimension. The adjustment motor 124 is rotationally driven by a start signal from the control section based on an output of the sheet selection sensor. Rotational force of the adjustment motor 124 is transmitted to an adjustment gear 121 through an adjustment drive gear 122. This adjustment gear 121 rotationally operates the recording sheet supply roller 40 through a connection member 123.

The pressure contact force adjustment mechanism 120 is adapted so that in the case where, e.g., a recording sheet 20 thin in thickness is used, the adjustment motor 124 rotationally drives the drive adjustment gear 124 in a counterclockwise direction as indicated by an arrow in FIG. 19. Rotation of the drive adjustment gear 124 is transmitted to the adjustment gear 121 to rotate it in a clockwise direction in the figure. Rotation of the adjustment gear 121 is transmitted to the connection member 123 through support shaft 3A to rotate the connection member 123 in one body in a clockwise direction as indicated by an arrow in the figure with the support shaft 3A being as fulcrum. Accordingly, the recording sheet supply roller 40 is rotationally operated in a clockwise direction in the figure in the state supported by the connection member 123 to push (thrust) the recording sheet 20 toward the lower side. For this reason, the recording sheet 20 is placed in the state where it is greatly curved along the outer circumferential portion of the recording sheet supply roller 40. Thus, pressure contact force with respect to the recording sheet contact roller 3 becomes large.

On the other hand, the pressure contact force adjustment mechanism 120 is adapted so that in the case where, e.g., a thick recording sheet 20 is used, the adjustment motor 124 rotationally drives the drive adjustment gear 124 in a clockwise direction in FIG. 19 to rotate the connection member 12B through the adjustment gear 121 in a counterclockwise direction in the figure with the support shaft 3A of the recording sheet contact roller 3 being as fulcrum. Accordingly, the recording sheet supply roller 40 is rotationally operated in a counterclockwise direction in the figure in the state supported by the connection member 123, and is moved toward the upper side with respect to the recording sheet 20. For this reason, curvature of the recording sheet 20 becomes small, and the pressure contact force with respect to the recording sheet contact roller 3 also becomes small. In this image forming apparatus, pressure contact force of the recording sheet 20 with respect to the recording sheet contact roller 3 is adjusted so that it becomes optimum.

It is to be noted that the pressure contact force adjustment mechanism is not limited to the above-described structure, but it is a matter of course that there is employed, e.g., a configuration adapted for directly driving, by adjustment motor, the support shaft 40A for supporting the recording sheet supply roller 40, or bracket member for supporting the support shaft 40A. Moreover, with respect to the pressure contact force adjustment mechanism, in the case where a pair of upper and lower recording sheet supply rollers 60, 61 or recording sheet supply rollers 65, 66 are provided as in the case of the above-described second and third embodiment image forming apparatuses, there may be employed a configuration adapted for allowing these recording sheet supply rollers 60, 61 to undergo adjustment operation in upper and lower directions to thereby change curved state of the recording sheet 20 to adjust contact pressure force of the recording sheet 20 with respect to the recording sheet connection roller 3 so that an optimum state results.

Further, in the case where the pressure contact force adjustment mechanism includes recording sheet supply rollers 70, 75 and a pair of guide rollers 71A, 71B or guide rollers 76A, 76B as in the case of the above-described fourth or fifth embodiment image forming apparatus, there may be employed a configuration adapted for allowing these recording sheet supply rollers 70, 75 and a pair of guide rollers 71A, 71B or guide rollers 76A, 76B to undergo adjustment operation in upper and lower directions to thereby change the curved state of the recording sheet 20 to adjust pressure contact force of the recording sheet 20 with respect to the recording sheet contact roller 3 so that an optimum state results. Moreover, with respect to the pressure contact force adjustment mechanism, spacing between a pair of guide rollers 71A, 71B or guide rollers 76A, 76B is adjusted to thereby change the curved state of the recording sheet 20 to adjust pressure contact force of the recording sheet 20 with respect to the recording sheet contact roller 3 so that an optimum state results.

Figure 20:
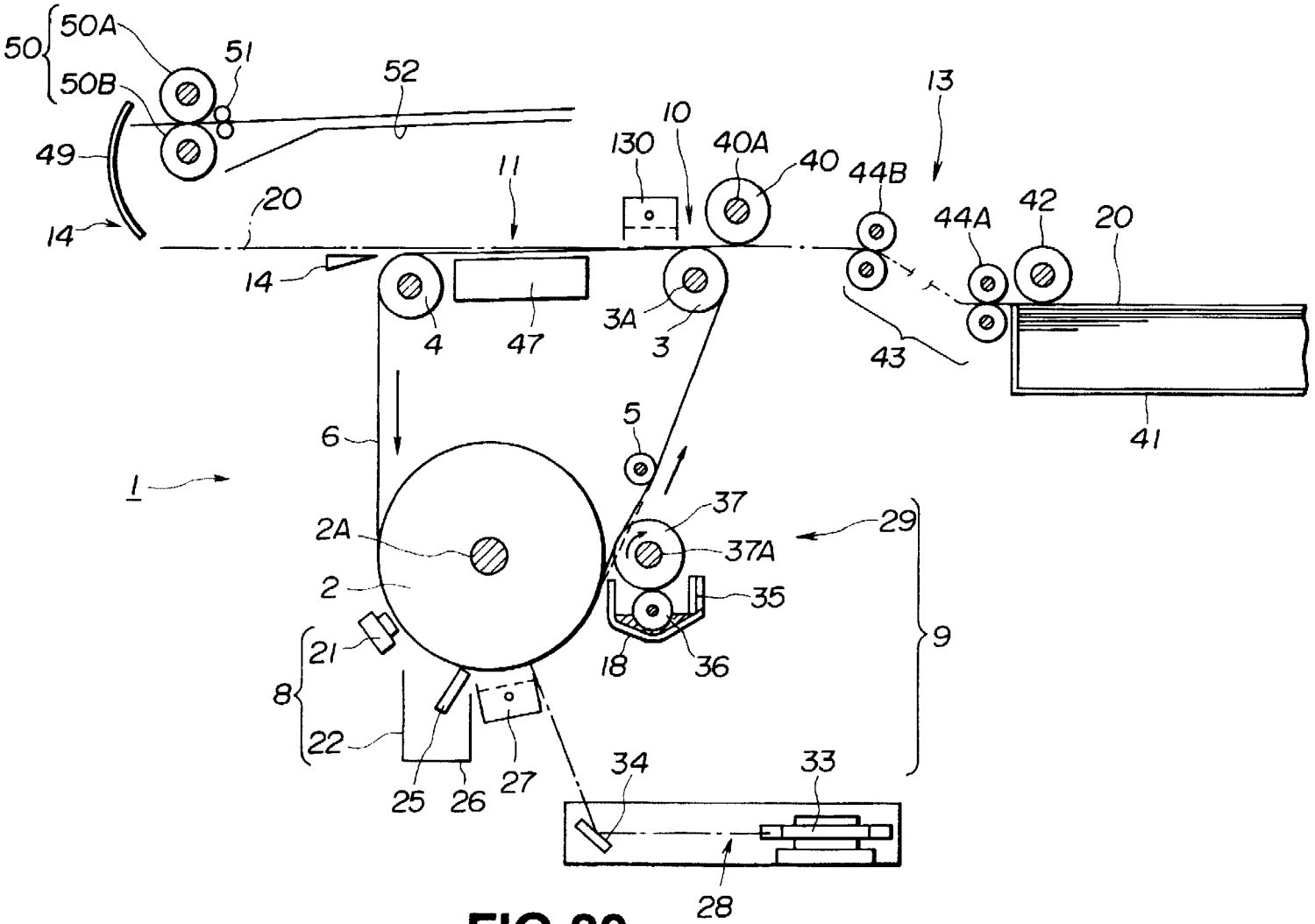
FIG. 20 is a view showing, in a model form, a further embodiment image forming apparatus provided with a second electrification charger for implementing electrification processing to recording sheet.

The tenth embodiment image forming apparatus shown in FIG. 20 is characterized in the configuration provided with a second electrification charger 130 positioned at the horizontal traveling path where the recording sheet 20 is laid upon the surface of endless belt-shaped photosensitive member 6 and is traveled in a horizontal direction, and adapted for electrifying, on the surface of the recording sheet 20, plus charges and minus charges which are of opposite polarity of the developer image 18A formed on the surface of endless belt-shaped photosensitive member 6.

The second electrification charger 130 is disposed in the state positioned between the recording sheet contact roller constituting a recording sheet supply section 13 and the cooling plate 47 constituting the cooling section 11 and in the proximity of the surface of the endless belt-shaped photosensitive member 6. As the second electrification charger 130, scorotron is employed similarly to the first electrification charger 27 constituting image preparation process section 9 thus to uniformly electrify the recording sheet 20 over the entirety of the surface from base 20A side so that minus charges result.

With respect to the solidified developer 18 constituting the developer image 18A on the surface of the endless belt-shaped photosensitive member 6, since the endless belt-shaped photosensitive member 6 is traveled in the state supported by the recording sheet contact roller 3 including a heating means 3D therein, and the recording sheet 20 is carried (conveyed) by the recording sheet supply roller 40 including a heating means 40B therein, whereby they are traveled in the state respectively heated so that their temperatures are more than the melting point of the dispersion medium of the solidified developer 18, the solidified developer 18 is held in a molten state at the second electrification charger 130 position. Moreover, the solidified developer 18 forming the developer image 18A is attached on the surface of the endless belt-shaped photosensitive member 6 from which minus charges are eliminated, and the developer particles have plus charges. Accordingly, the developer particles of the developer image 18 portion are attracted toward the recording sheet 20 side where minus charges are electrified by the second electrification charger 130.

As stated above, the image forming apparatus is of a structure in which there is provided a second electrification charger for electrifying charges of opposite polarity of charges of developer particles of the solidified developer 18 onto the recording sheet 20 so that an electrostatic coupling force is produced between the recording sheet 20 and the developer image 18A. Accordingly, the developer image 18A formed on the surface of the endless belt-shaped photosensitive member 6 is transferred onto the recording sheet 20 with extremely high accuracy, and missing of transfer image is prevented.

In this image forming apparatus, since recording sheet 20 is laid upon endless belt-shaped photosensitive member 6, whereby solidified developer 18 carries out transfer of developer image 18A in the molten state, there is the possibility that image flow phenomenon by flow of the solidified developer 18 might take place. Such image flow phenomenon is further promoted by heating endless belt-shaped photosensitive member 6 by recording sheet contact roller 3 including heating means 3D therein so that its temperature is more than the melting point of the dispersion medium of the solidified developer 18, and allowing the recording sheet 20 to be laid upon the endless belt-shaped photosensitive member in the state heated so that its temperature is more than the melting point of the dispersion medium of the solidified developer 18 by the recording sheet supply roller 40 including heating means 40B therein in order to improve transfer efficiency.

Figure 21:
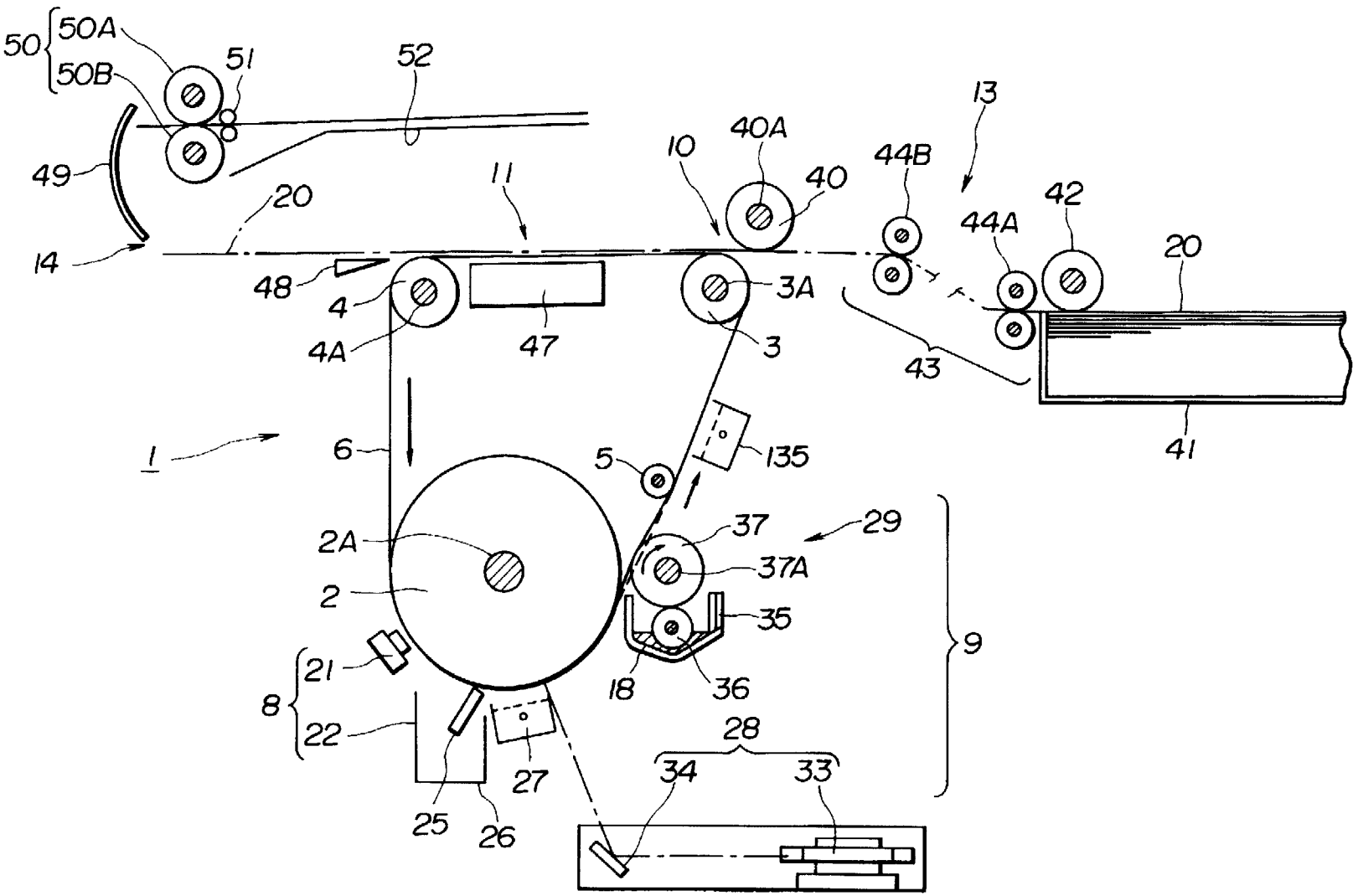
FIG. 21 is a view showing, in a model form, a further embodiment image forming apparatus provided with a second electrification charger for implementing electrification processing to developer image formed on the surface of endless belt-shaped photosensitive member.

The eleventh embodiment image forming apparatus shown in FIGS. 21 and 2Z contemplates enhancing the adhesive force of the solidified developer 18 with respect to the endless belt-shaped photosensitive member 6 to prevent occurrence of such flow phenomenon of transfer image. This image forming apparatus is characterized in the configuration provided with a second electrification charger 135 positioned between the image preparation process section 9 and the recording sheet supply section 13 adapted so that recording sheet 20 is delivered thereto and is laid thereon, and adapted for further delivering plus charges of the same polarity to the developer image 18A formed on the surface of the endless belt-shaped photosensitive member 6 and electrifying the developer image 18A.

The second electrification charger 135 is disposed in the state positioned between the developing section 29 constituting the image preparation process section 9 and the recording sheet contact roller 3 at which the endless belt-shaped photosensitive member 6 is turned back in a horizontal direction and recording sheet 20 is laid thereon, and in the proximity of the surface of the endless belt-shaped photosensitive member 6. As the second electrification charger 135, scorotron is employed similarly to the first electrification charger 27 constituting the image preparation process section 9. Plus charges are delivered to the developer image 18A formed on the surface of the endless belt-shaped photosensitive member 6 so that it is electrified. In this example, the second electrification charger 135 is controlled by a control section so that plus charges are delivered and electrified in correspondence with the area where the developer image 18A is formed with respect to the endless belt-shaped photosensitive member 6.

Figure 22:
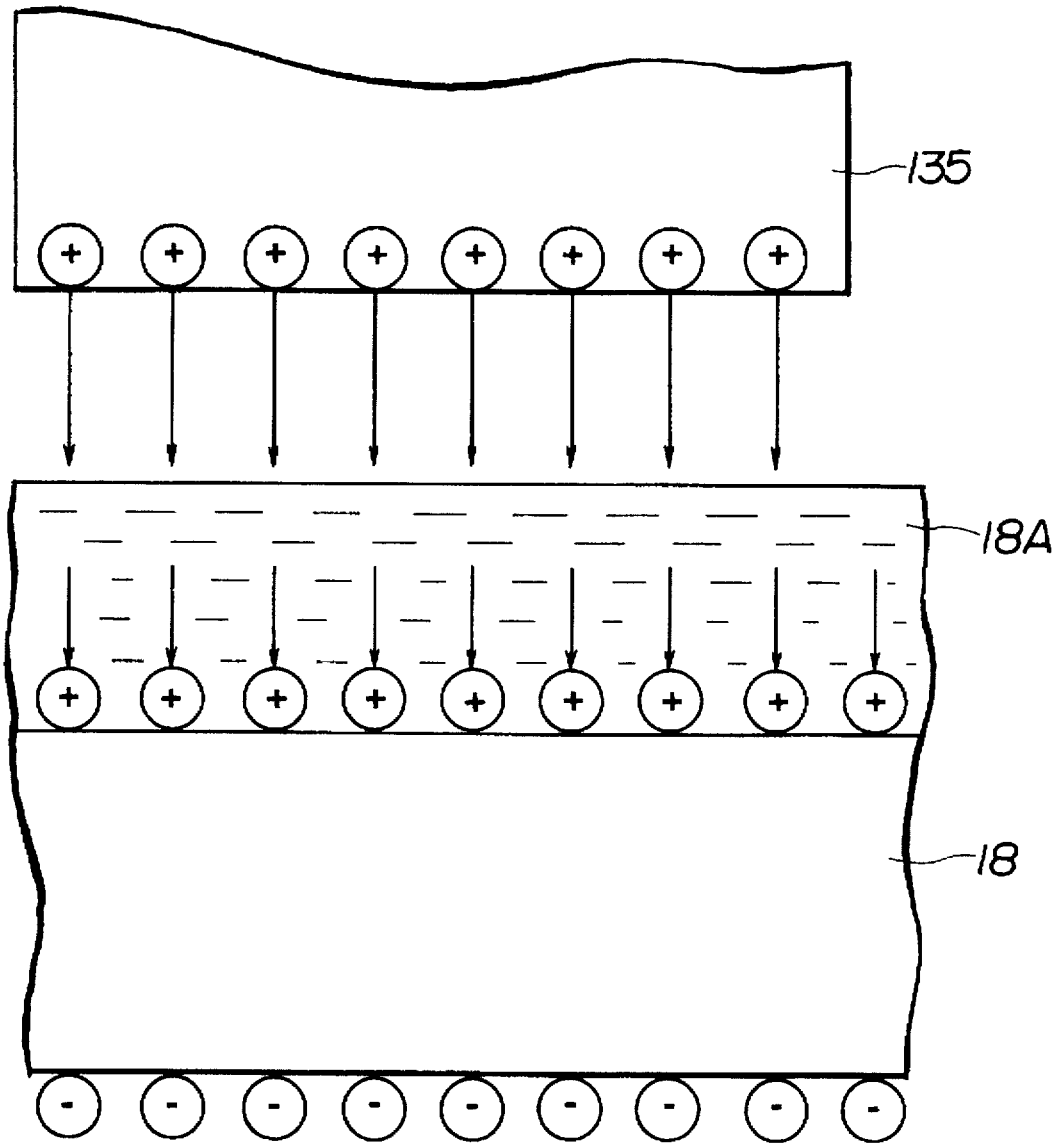
FIG. 22 is a model view for explaining movement (transfer) state of charges in the image forming apparatus.

Accordingly, in the developer image 18A, developer particles are attached on the surface of the endless belt-shaped photosensitive member 6 in the state where they have plus charges. In this example, as shown in FIG. 22, plus charges are further delivered by the second electrification charger 135, whereby the entire charge quantity is increased. Thus, the cohesive force of developer particles is enhanced and the adhesive force with respect to the endless belt-shaped photosensitive member 6 is strengthened. In addition, with respect to the developer image 18A, since plus charges delivered thereto are delivered in a direction perpendicular to the surface of the endless belt-shaped photosensitive member 6, whereby directivity of plus charges of developer particles is put in order.

As described above, in the image forming apparatus, there is provided a second electrification charger for electrifying charges having a polarity opposite to that of the charges of developer particles of the solidified developer 18 on the recording sheet, whereby the developer image 18A attached on the surface of the endless belt-shaped photosensitive member 6 is caused to be in a stable state. Thus, image flow phenomenon is prevented. Accordingly, in this image forming apparatus, developer image 18A is transferred with high accuracy onto the recording sheet 20 laid upon the surface of the endless belt-shaped photosensitive member 6. In addition, since directivity of plus charges of developer particles is put in order, developer image 18A is transferred onto the recording sheet 20 in the state of sharp contour free from lateral shift.

Figure 23:
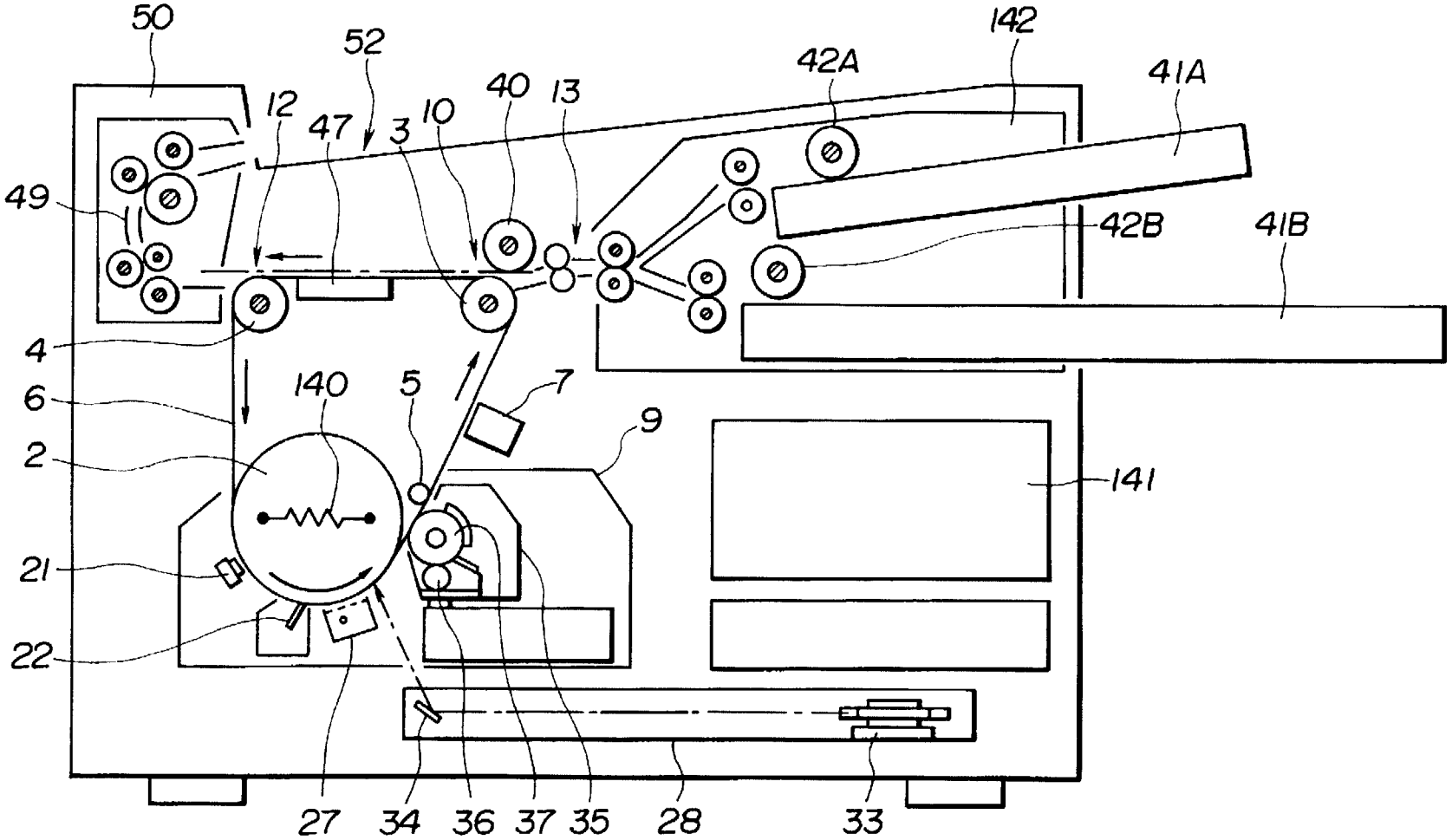
FIG. 23 is a view showing, in a model form, a further embodiment image forming apparatus provided with heating means within drive roller.

The twelfth embodiment image forming apparatus shown in FIG. 23 is characterized in the configuration in which the heating means 140 for heating the endless belt-shaped photosensitive member 6 so that its temperature is more than the melting point of the dispersion medium of the solidified developer 18 is disposed within the drive roller 2. The drive roller 2 is formed tubular by a metal material having high thermal conductivity and relatively light weight, e.g., aluminum material so that the outer circumferential surface is smooth. While the heating means is comprised of a resistor, it may be the heating means of the panel heater type circular arc shaped in cross section along the inner circumferential portion facing to the image preparation process section 9. In addition, the heating means 140 may be of, e.g., a structure in which the support shaft is formed tubular so that the halogen heater is disposed therein similarly to the above-described respective embodiment image forming apparatuses.

In this embodiment image forming apparatus, as shown in FIG. 23, position detecting the means 7 for detecting initial end and terminating end of the endless belt-shaped photosensitive member 6 is disposed along the traveling path of the endless belt-shaped photosensitive member 6 in the state positioned between the image preparation process section 9 and the recording sheet contact roller 3. A detection output detected by the position detecting means 7 is sent out to a control section 141. The control section 141 carries out, on the basis of the detection output of the position detecting means 7, control of starting operation of image formation by the image preparation process section 9 or supply operation of recording sheet 20, etc. with respect to the endless belt-shaped photosensitive member 6.

Moreover, in the embodiment image forming apparatus, as shown in FIG. 23, there is constituted a cassette loading section 142 which can load recording sheet cassettes 41A, 41B in the state of the double stage in upper and lower directions. Accordingly, in the image forming apparatus, e.g., in reading operation of a print manuscript by scanner, size designation of recording sheet 20 is carried out. Thus, recording sheet 20 is sent out from any one of the recording sheet cassettes 41A, 41B to the recording sheet supply section 13 through the control section 141.

In accordance with the embodiment image forming apparatus thus constituted, heating means is disposed within the drive roller 2 for supporting the endless belt-shaped photosensitive member 6 to travel it in a stable state, whereby the endless belt-shaped photosensitive member 6 is securely heated so that its temperature is more than the melting point of the dispersion medium of the solidified developer 18 to hold the solidified developer 18 attached on the surface thereof so that it is in a molten state. Accordingly, this image forming apparatus allows the configuration in which heating means is disposed in correspondence with the developing section 29 to become unnecessary. Thus, the entire structure is simplified and a high accuracy image transfer can be carried out.

Figure 24:
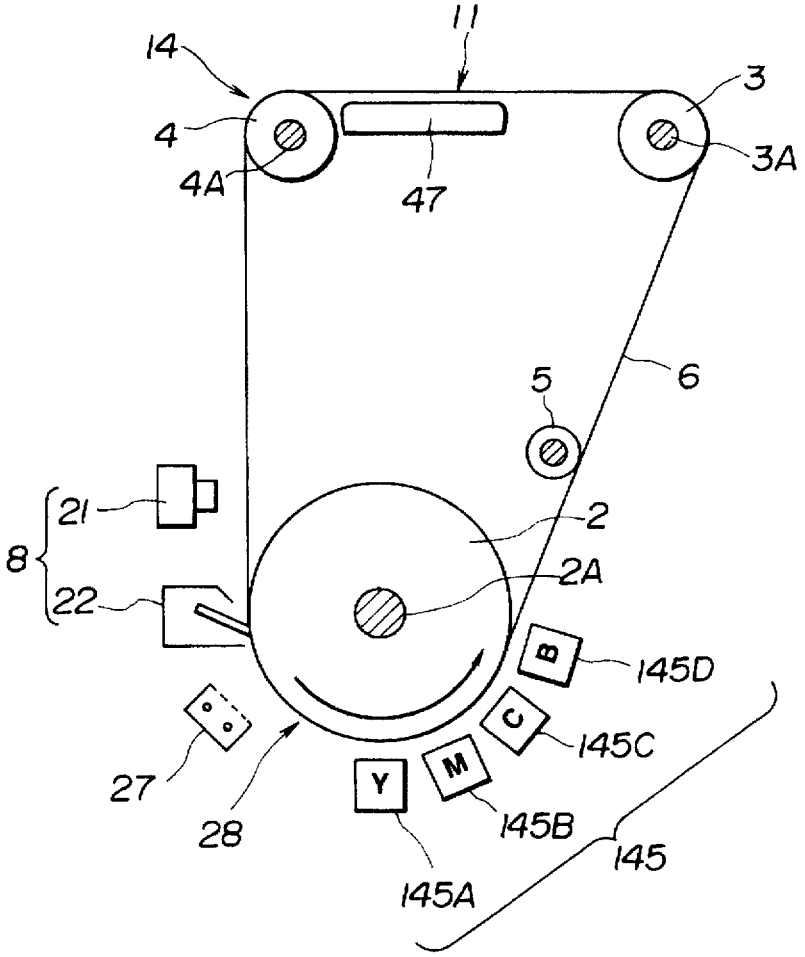
FIG. 24 is a view showing, in a model form, a further embodiment image forming apparatus for carrying out color transfer.

In the thirteenth embodiment image forming apparatus shown in FIG. 24, a developing section 145 disposed at the position of the succeeding stage of the image preparation process section is constituted by a plurality of color developing sections 145A to 145D thus to carry out transfer of color image onto recording sheet 20. The color developing sections 145A to 145D are of a structure in which yellow developing section 145A, magenta developing section 145B, cyan developing section 145C and black developing section 145D, etc. are arranged in order along the traveling direction of the endless belt-shaped photosensitive member 6.

It is to be noted that while there are known, with respect to the image forming apparatus for carrying out color transfer, a system of carrying out color superposition processing of yellow, magenta, cyan and black thereafter to carry out collective transfer onto recording sheet 20 and a system of transferring, every time, respective color images of yellow, magenta, cyan and black to carry out color superposition processing onto the recording sheet 20, any system may be used.

Figure 25:
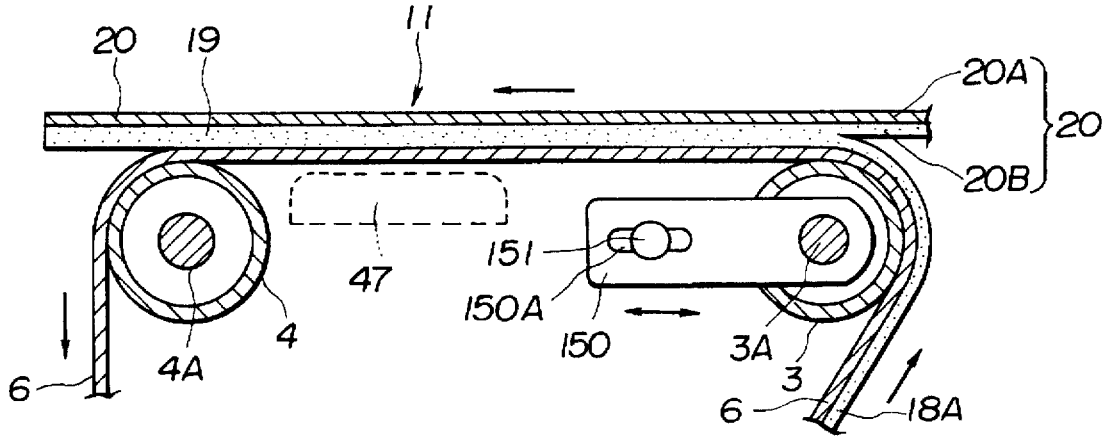
FIG. 25 is an essential part longitudinal cross sectional view showing a further embodiment image forming apparatus provided with adjustment mechanism for traveling tension of endless belt-shaped photosensitive member.

The fourteenth embodiment image forming apparatus shown in FIG. 25 is of a structure adapted for adjusting traveling tension of the endless belt-shaped photosensitive member 6 laid upon drive roller 2, recording sheet contact roller 3, recording sheet peeling roller 4 and backing roller 5, etc. and caused to undergo endless traveling. The recording sheet connection roller 3 is supported and mounted, as shown in the figure, on one side of a supporting bracket member 150 attached on the sub-frame 15. At the supporting bracket member 150, an attachment hole 150A constructed as an elongated hole in a horizontal direction is formed at the other end side thereof. Thus, supporting bracket member 150 is attached to the sub-frame 15 through an attachment screw 151.

Accordingly, the recording sheet contact roller 3 is fixed to the sub-frame 15 through the attachment screw 151 by adjustably moving the supporting bracket member 150 in a horizontal direction in the length range of the attachment screw 151, whereby the spacing with respect to the recording sheet peeling roller 4 is adjusted. The image forming apparatus narrows, e.g., spacing between the recording sheet contact roller 3 and the recording sheet peeling roller 4 so that the stretching state of the endless belt-shaped photosensitive member 6 is loosened, and to broaden such spacing so that the stretching state of the endless belt-shaped photosensitive member 6 is tightened. In the endless belt-shaped photosensitive member 6, traveling tension is adjusted in this way so that an optimum state results.

It is to be noted that the adjustment mechanism for the traveling tension is not limited to the above-described structure, but there may be employed a configuration adapted for movably supporting recording sheet peeling roller 4 side, or there may be employed a configuration adapted for adjustably supporting both the recording sheet contact roller 3 and recording sheet peeling roller 4. Further, the supporting structure of the recording sheet contact roller 8 and/or the recording sheet peeling roller is not limited to the supporting structure of the above-described bracket member 150, but there may be employed a configuration in which support shafts 3A, 4A of the recording sheet contact roller 3 and the recording sheet peeling roller 4 are connected by elastic means to adjust the biasing force of the elastic means to thereby adjust the traveling tension of the endless belt-shaped photosensitive member 6 so that an optimum state results.

As described above, the image forming apparatus according to this invention employs a configuration in which the photosensitive member is constituted by an endless belt-shaped photosensitive member to allow the endless belt-shaped photosensitive member to be laid across a drive roller of slightly greater diameter and a plurality of guide rollers to travel it to dispose image preparation process section at the outer circumferential portion of the drive roller for traveling the endless belt-shaped photosensitive member in a stable state to form developer image on the surface of the endless belt-shaped photosensitive members and to allow the recording sheet to be laid upon the surface of the endless belt-shaped photosensitive member within horizontal traveling path where the endless belt-shaped photosensitive member is stably traveled between the recording sheet contact roller and the recording sheet peeling roller constituting the guide rollers to carry out transfer of the developer image to further carry out peeling between the recording sheet and the endless belt-shaped photosensitive member, the image forming apparatus is simple in structure as a whole so that it is possible to carry out formation of large image while allowing the apparatus to be compact.

Moreover, since the image forming apparatus according to this invention is adapted so that management of the state of developer image formed on the endless belt-shaped photosensitive member is carried out with high accuracy and transfer operation onto the recording sheet laid upon the surface of the endless belt-shaped photosensitive member is carried out, occurrence of missing phenomenon, collapse phenomenon or flow phenomenon, etc. of transfer image is prevented. Thus, high accuracy image transfer is carried out.

In addition, in the image forming apparatus according to this invention, in the case where recording sheet laid upon the surface of the endless belt-shaped photosensitive member is clogged in the middle of carrying (conveying), it is possible to remove the recording sheet by an extremely easy operation. Thus, great improvement in workability of maintenance can be made.

What is claimed is:

1. An image forming apparatus comprising:

a solidified developer which is solid at an ordinary temperature, is molten by implementing a heating processing thereto, and is re-solidified by implementing a cooling processing thereto and including printing particles dispersed in a dispersion medium of the solidified developer;

an endless belt-shaped photosensitive member;

a traveling guide section composed of a drive roller of a first diameter and a pair of guide rollers of a second, smaller diameter disposed in such a manner that their respective outer circumferential surfaces mutually constitute the same plane with respect to a horizontal direction, the traveling guide section being adapted to allow the endless belt-shaped photosensitive member to be laid across the respective rollers for undergoing endless traveling;

an image preparation process section comprised of electrification means for electrifying an entire surface of the endless belt-shaped photosensitive member, exposure means for allowing the surface of the endless belt-shaped photosensitive member electrified on the basis of a picture signal to be exposed to light to form an electrostatic latent image, and development means for delivering the solidified developer in a molten state to the surface of the endless belt-shaped photosensitive member to form a developer image corresponding to the electrostatic latent image, the electrification means, the exposure means, and the development means being disposed in order along a traveling direction of the endless belt-shaped photosensitive member at the outer circumferential portion of the drive roller of the traveling guide section;

a recording sheet supply section for delivering a recording sheet;

a recording sheet delivered from the recording sheet supply section and caused to be closely in contact with the surface of the endless belt-shaped photosensitive member on which a developer image is formed;

heating means for heating one of the endless belt-shaped photosensitive member or the recording sheet so that a temperature thereof is more than the melting point of the dispersion medium of the solidified developer to cause the developer image formed on the surface of the endless belt-shaped photosensitive member to be in a molten state;

cooling means disposed at a front end portion where the endless belt-shaped photosensitive member is traveled in a horizontal direction and adapted for cooling the endless belt-shaped photosensitive member with which the recording sheet is closely in contact and the recording sheet so that the solidified developer in a molten state for forming the developer image is re-solidified on the surface of the recording sheet and is transferred thereto while the surface of the belt-shaped photosensitive member and the recording sheet are horizontally disposed; and peeling means for peeling from the endless belt-shaped photosensitive member the recording sheet to which the developer image is transferred from the endless belt-shaped photosensitive member.

2. An image forming apparatus as set forth in claim 1, wherein the recording sheet further includes a resin layer compatible with the dispersion medium of the solidified developer formed on the surface of the side closely in contact with the surface of the endless belt-shaped photosensitive member.

3. An image forming apparatus as set forth in claim 1, wherein the drive roller is formed by a light-weight metal material having a high thermal conductivity, and heating means disposed in the drive roller for heating the endless belt-shaped photosensitive member so that the temperature thereof is more than the melting point of the dispersion medium of the solidified developer.

4. An image forming apparatus as set forth in claim 1, wherein the pair of guide rollers across which the endless belt-shaped photosensitive member is laid to constitute the traveling guide section is composed of:

a recording sheet contact roller for causing the endless belt-shaped photosensitive member traveled from the drive roller side to undergo turn-over traveling and for causing the recording sheet delivered from the recording sheet supply section disposed at the side portion of the image forming apparatus to be laid upon the surface of the endless belt-shaped photosensitive member to travel thereon; and a recording sheet peeling roller for causing the endless belt-shaped photosensitive member turned back and traveled by the recording sheet contact roller to undergo turn-back traveling toward the drive roller side and for peeling from the endless belt-shaped photosensitive member the recording sheet to which the developer image is transferred, whereby the endless belt-shaped photosensitive member travels in a horizontal direction in the state where the recording sheet is laid thereupon between the recording sheet contact roller and the recording sheet peeling roller.

5. An image forming apparatus as set forth in claim 4, wherein the recording sheet contact roller and the recording sheet peeling roller are disposed in the state positioned at an upper part with respect to the drive roller, and a horizontal traveling portion where the recording sheet of the endless belt-shaped photosensitive member is traveled in the state laid thereupon is constructed in the state positioned in an upper direction with respect to the image preparation process section.

6. An image forming apparatus as set forth in claim 4, wherein the drive roller, the recording sheet contact roller and the recording sheet peeling roller across which the endless belt-shaped photosensitive member is laid to constitute the traveling guide section are assembled into a chassis drawn out toward an upper part with respect to an apparatus casing.

7. An image forming apparatus as set forth in claim 4, wherein at least any one of the recording sheet contact roller and the recording sheet peeling roller for carrying out traveling guide of the endless belt-shaped photosensitive member is supported at a movable supporting portion where a fixed position is adjusted with respect to a frame to fix the movable supporting portion by adjustment movement so that tension of the endless belt-shaped photosensitive member is adjusted.

8. An image forming apparatus as set forth in claim 4, wherein recording sheet guide means is disposed between the recording sheet contact roller and the recording sheet supply section, and wherein the recording sheet guide means travels the recording sheet delivered from the recording sheet supply section in a manner to allow it to come into contact with the surface of the endless belt-shaped photosensitive member turned back by the recording sheet roller, whereby the recording sheet is traveled in a manner laid upon the surface of the endless belt-shaped photosensitive member in the state where a small pressure is applied by a rigidity of the recording sheet.

9. An image forming apparatus as set forth in claim 8, wherein the recording sheet guide means includes a recording sheet bending section permitting a portion of the recording sheet delivered from the recording sheet supply section and adapted so that the front end portion thereof is caused to come into contact with the surface of the endless belt-shaped photosensitive member to be bent with respect to the traveling direction.

10. An image forming apparatus as set forth in claim 8, wherein the recording sheet guide means is constituted by a guide member for supporting the recording sheet delivered from the recording sheet supply section to travel it, and a recording sheet supply roller adapted so that a support shaft is disposed at an upper position slightly closer to the recording sheet supply section side with respect to a support shaft of the recording sheet contact roller and it travels the recording sheet toward the recording sheet contact roller side in the state where the recording sheet is put between the recording sheet supply roller and the guide member, and wherein the recording sheet supply roller travels the recording sheet toward the recording sheet contact roller at a speed different from a traveling speed of the endless belt-shaped photosensitive member.

11. An image forming apparatus as set forth in claim 8, wherein the recording sheet guide means is constituted by a guide member for supporting the recording sheet delivered from the recording sheet supply section to travel it and a recording sheet supply roller adapted so that a support shaft thereof is disposed at an upper position closer to the recording sheet supply section side with respect to a support shaft of the recording sheet contact roller and it travels the recording sheet toward the recording sheet contact roller side in the state where the recording sheet is put between the recording sheet supply roller and the guide member, and wherein the recording sheet delivered from the recording sheet supply section is caused to come into contact with the outer circumferential portion of the recording sheet supply roller so that the traveling direction is changed to the recording sheet contact roller side, whereby the recording sheet is traveled in a manner laid upon the surface of the endless belt-shaped photosensitive member in the state where a small pressure is applied by a pressure contact force based on a rigidity of the recording sheet.

12. An image forming apparatus as set forth in claim 11, wherein the recording sheet supply roller is supported by the guide member for supporting the recording sheet to travel it so that the recording sheet supply roller comes into contact with the guide member and is away therefrom, whereby the pressure contact force with respect to the recording sheet is adjusted.

13. An image forming apparatus as set forth in claim 8, wherein the recording sheet guide means is constituted by a recording sheet supply roller adapted so that a support shaft is disposed at an upper position slightly closer to the recording sheet supply section side with respect to a support shaft of the recording sheet contact roller and it supports the recording sheet delivered from the recording sheet supply section to travel it, and a guide member disposed at an upper position in a manner opposite to the recording sheet supply roller to travel the recording sheet toward the recording sheet contact roller side in the state where the recording sheet is put therebetween, and wherein the recording sheet delivered from the recording sheet supply section is traveled in a manner laid upon the endless belt-shaped photosensitive member in the state where a very small pressure is applied to the surface thereof by the recording sheet supply roller and the guide member.

14. An image forming apparatus as set fort in claim 13, wherein the heating means comprises: recording sheet heating means disposed between the recording sheet supply section and the recording sheet contact roller, and wherein the recording sheet is traveled toward the recording sheet contact roller side in the state heated by the recording sheet heating means so that its temperature is more than the melting point of the dispersion medium of the solidified developer and is laid upon the endless belt-shaped photosensitive member.

15. An image forming apparatus as set forth in claim 14, wherein the recording sheet heating means is constituted by a tubular recording sheet supply roller and a heating element disposed within the recording sheet supply roller.

16. An image forming apparatus as set forth in claim 13, wherein the heating means comprises recording sheet preliminary heating means for heating the recording sheet so that its temperature is more than the melting point of the dispersion medium of the solidified developer is disposed between the recording sheet guide means and the recording sheet contact roller.

17. An image forming apparatus as set forth in claim 16, wherein the recording sheet preliminary heating means is constituted by a tubular guide roller positioned at the recording sheet supply section side with respect to the recording sheet to travel it toward the recording sheet contact roller side and a heating element disposed within the guide roller.

18. An image forming apparatus as set forth in claim 13, wherein cooling means is disposed in correspondence with the endless belt-shaped photosensitive member traveled in a horizontal direction between the recording sheet contact roller and the recording sheet peeling roller to cool, by the time the endless belt-shaped photosensitive member and the recording sheet reach the recording sheet peeling roller, the endless belt-shaped photosensitive member and the recording sheet so that their respective temperatures are less than the melting point of the dispersion of the solidified developer.

19. An image forming apparatus as set forth in claim 8, wherein the recording sheet contact roller is formed in a tubular shape so that the heating means is disposed therein to heat, in the process of allowing the endless belt-shaped photosensitive member to undergo turn-back traveling in a horizontal direction, the solidified developer so that its temperature is more than the melting point of the dispersion medium.

* * * * *